US009555633B2

(12) United States Patent
Ohnishi

(10) Patent No.: US 9,555,633 B2
(45) Date of Patent: Jan. 31, 2017

(54) REPLAY UNIT FOR WASTE LIQUID CONTAINER AND IMAGE FORMING APPARATUS INCORPORATING THE RELAY UNIT

(71) Applicant: Masashi Ohnishi, Kanagawa (JP)

(72) Inventor: Masashi Ohnishi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/878,033

(22) Filed: Oct. 8, 2015

(65) Prior Publication Data

US 2016/0103414 A1 Apr. 14, 2016

(30) Foreign Application Priority Data

Oct. 9, 2014 (JP) ..... 2014-207727
Feb. 9, 2015 (JP) ..... 2015-023516

(51) Int. Cl.

| | |
|---|---|
| ***B41J 2/165*** | (2006.01) |
| ***B41J 2/17*** | (2006.01) |
| ***G03G 21/10*** | (2006.01) |
| ***G03G 15/10*** | (2006.01) |
| ***G03G 21/12*** | (2006.01) |

(52) U.S. Cl.

CPC ..... *B41J 2/16523* (2013.01); *B41J 2/16508* (2013.01); *B41J 2/16511* (2013.01); *B41J 2/1721* (2013.01); *G03G 15/10* (2013.01); *G03G 21/105* (2013.01); *G03G 21/12* (2013.01); *B41J 2002/1728* (2013.01)

(58) Field of Classification Search

CPC ..... B41J 2/16523; B41J 2/1721; B41J 2002/1728; B41J 2002/1735; B41J 2002/1742; B41J 2002/1856

See application file for complete search history.

(56) References Cited

U.S. PATENT DOCUMENTS

2009/0015632 A1 1/2009 Suzuki et al.
2009/0315943 A1 12/2009 Ohnishi et al.

(Continued)

FOREIGN PATENT DOCUMENTS

JP 2004-130701 4/2004
JP 2006-281508 10/2006

(Continued)

*Primary Examiner* — Jason Uhlenhake
(74) *Attorney, Agent, or Firm* — Cooper & Dunham LLP

(57) ABSTRACT

An image forming apparatus includes an apparatus body, a waste liquid container accommodation part, and a waste liquid drain passage member. The waste liquid container accommodation part replaceably accommodates a first waste liquid container to contain waste liquid. The waste liquid drain passage member guides waste liquid into the waste liquid container accommodation part. The apparatus body includes a mount portion to mount a second waste liquid container having a capacity greater than the waste liquid container accommodation part. The mount portion of the apparatus body is different from the waste liquid container accommodation part. The waste liquid container accommodation part accommodates a relay unit to relay a drain passage from the waste liquid drain passage member to the second waste liquid container, replaceably with the first waste liquid container.

12 Claims, 43 Drawing Sheets

(56) References Cited

U.S. PATENT DOCUMENTS

| | | | | |
|---|---|---|---|---|
| 2010/0165040 | A1 | 7/2010 | Ohnishi et al. | |
| 2013/0141493 | A1 | 6/2013 | Ohnishi | |
| 2013/0241995 | A1* | 9/2013 | Maruyama | B41J 2/16523 347/36 |
| 2014/0071211 | A1 | 3/2014 | Kawajiri et al. | |
| 2014/0247304 | A1* | 9/2014 | Wakabayashi | B41J 2/16517 347/32 |
| 2015/0054898 | A1 | 2/2015 | Kondo et al. | |
| 2015/0077478 | A1 | 3/2015 | Kawabata et al. | |

FOREIGN PATENT DOCUMENTS

| | | |
|---|---|---|
| JP | 2008-229920 | 10/2008 |
| JP | 2009-018529 | 1/2009 |
| JP | 2013-193215 | 9/2013 |

* cited by examiner

REPLAY UNIT FOR WASTE LIQUID CONTAINER AND IMAGE FORMING APPARATUS INCORPORATING THE RELAY UNIT

CROSS-REFERENCE TO RELATED APPLICATIONS

This patent application is based on and claims priority pursuant to 35 U.S.C. §119(a) to Japanese Patent Application Nos. 2014-207727, filed on Oct. 9, 2014, and 2015-023516, filed on Feb. 9, 2015, in the Japan Patent Office, the entire disclosure of each of which is hereby incorporated by reference herein.

BACKGROUND

Technical Field

Aspects of this disclosure relate to a relay unit for a waste liquid container and an image forming apparatus incorporating the relay unit.

Description of the Related Art

An image forming apparatus according to a liquid discharge recording system typically produces waste liquid with maintenance operation of a liquid discharge head. Hence, an image forming apparatus may have, for example, a stationary waste liquid container (also referred to as waste-liquid tank) or a replaceable waste-liquid tank.

SUMMARY

In an aspect of this disclosure, there is provided an image forming apparatus including an apparatus body, a waste liquid container accommodation part, and a waste liquid drain passage member. The waste liquid container accommodation part replaceably accommodates a first waste liquid container to contain waste liquid. The waste liquid drain passage member guides waste liquid into the waste liquid container accommodation part. The apparatus body includes a mount portion to mount a second waste liquid container having a capacity greater than the waste liquid container accommodation part. The mount portion of the apparatus body is different from the waste liquid container accommodation part. The waste liquid container accommodation part accommodates a relay unit to relay a drain passage from the waste liquid drain passage member to the second waste liquid container, replaceably with the first waste liquid container.

In another aspect of this disclosure, there is provided a relay unit for a waste liquid container of an image forming apparatus. The relay unit includes a first connector and a second connector to be connected to a waste liquid drain passage member and a second waste liquid container, respectively, of the image forming apparatus to relay a drain passage from the waste liquid drain passage member to the second waste liquid container. The waste liquid drain passage member guides waste liquid to a waste liquid container accommodation part of the image forming apparatus. The second waste liquid container has a capacity greater than a first waste liquid container and is mountable to a portion of the image forming apparatus different from the waste liquid container accommodation part. The waste liquid container accommodation part of the image forming apparatus replaceably accommodates the first waste liquid container. The relay unit is mountable in the waste liquid container accommodation part of the image forming apparatus, replaceably with the first waste liquid container.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
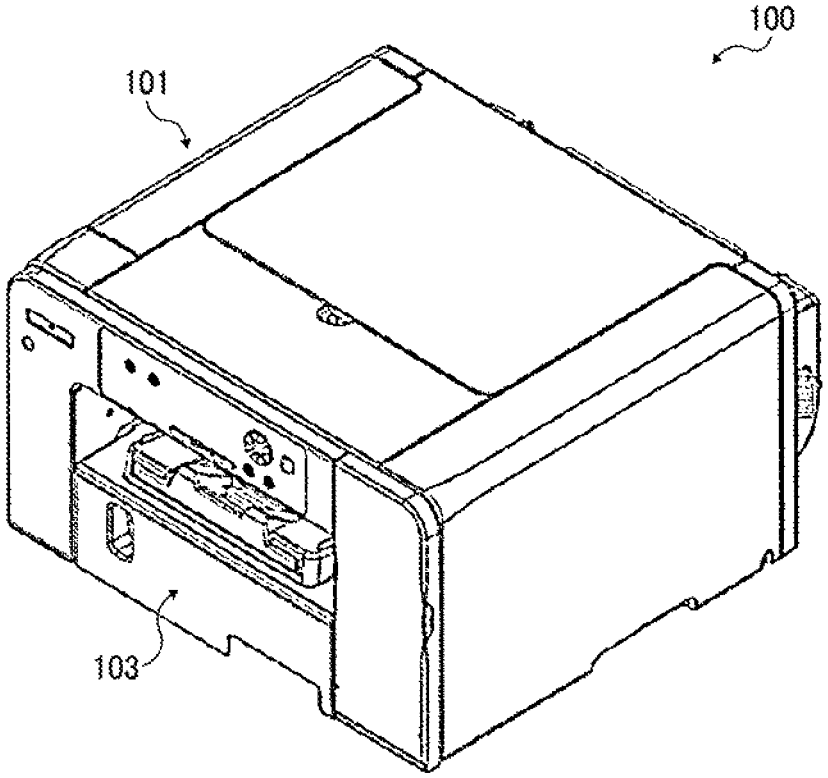
FIG. 1 is an outer perspective view of an image forming apparatus according to an embodiment of this disclosure, in which a second waste liquid container is not mounted.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

A replaceable waste liquid tank is likely to decrease the product life due to an increase in the amount of waste liquid accompanying with an increase in the nozzle density of a recording head. Accordingly, the replacement frequency of waste liquid tanks is likely to increase. In such a case, it is conceivable to increase the capacity of a waste liquid tank to decrease the replacement frequency of the waste liquid tank. However, an increased capacity of the waste liquid tank causes an increase in the size of an image forming apparatus.

Hence, it is conceivable to adopt a configuration in which a user can selectively mount a large volume of waste liquid tank that is presupposed not to be replaced with at least a small volume of replaceable waste liquid tank. In such a case, if two types of waste liquid tanks are selectively mountable and a small volume of waste liquid tank and a large volume of tank are mountable at different portions, a joint (connection) structure of the small volume of waste liquid tank and the large volume of waste tank is a challenge.

As described below, according to at least one aspect of this disclosure, a simplified joint (connection) structure is obtained of a waste liquid drain passage and each of a waste liquid tank having a smaller capacity and a second waste liquid tank having a larger capacity mounted to different portions.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments of the present disclosure are described with reference to the attached drawings. First, an example of an image forming apparatus according to an embodiment of this disclosure is described with reference to FIG. 1. FIG. 1 is an outer perspective view of an image forming apparatus according to an embodiment of this disclosure, in which a second waste liquid container is not mounted.

An image forming apparatus 100 according to this embodiment is a serial-type image forming apparatus. A feed and discharge tray 103 is removably attached relative to a front side of an apparatus body 101. The feed and discharge tray 103 is a single unit in which a feed tray to store media (sheets of paper) is integrated with an ejection tray to receive recording media on which images are formed.

Figure 2:
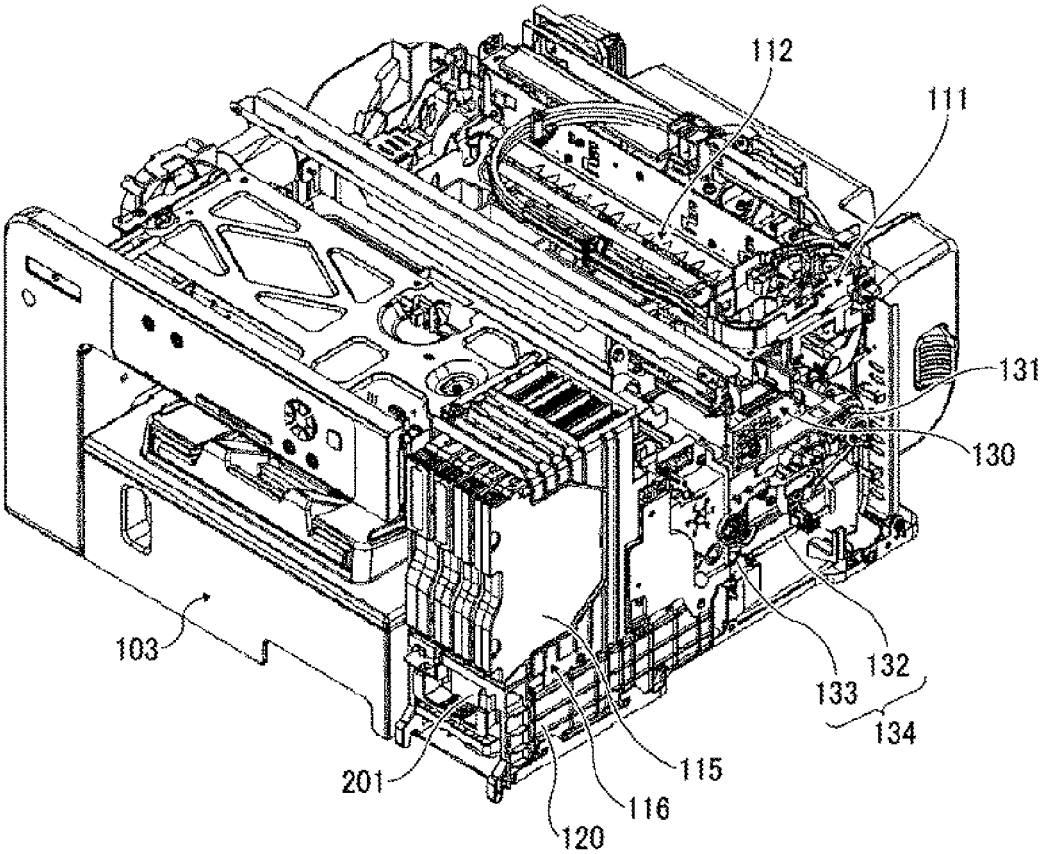
FIG. 2 is a perspective view of a mechanical section of the image forming apparatus of FIG. 1.
Figure 3:
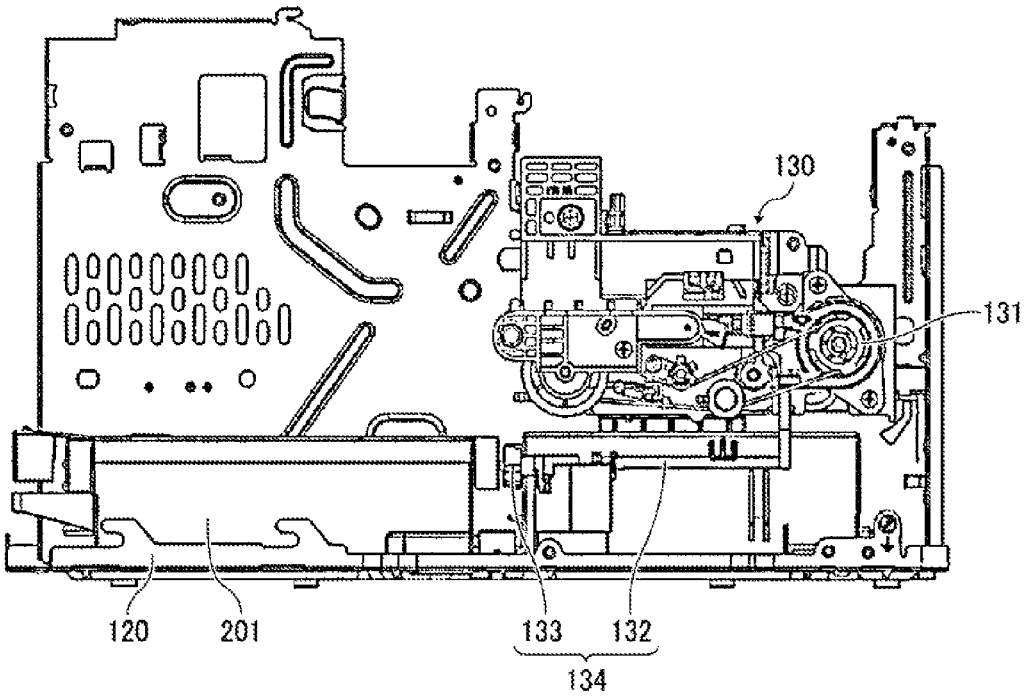
FIG. 3 is a side view of the mechanical section of FIG. 2.
Figure 4:
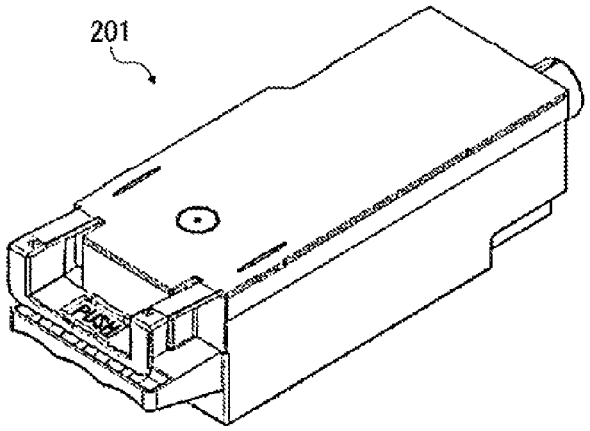
FIG. 4 is an outer perspective view of a first waste liquid container.

Next, a mechanical section of the image forming apparatus 100 in this embodiment is described with reference to FIGS. 2 through 4. FIG. 2 is a perspective view of the mechanical section in this embodiment. FIG. 3 is a side view of the mechanical section. FIG. 4 is an outer perspective view of a first waste liquid container in this embodiment.

In the apparatus body 101, a carriage unit 111 mounting a recording head is disposed to be reciprocally movable in a main scanning direction. The recording head includes a liquid discharge head to discharge liquid droplets onto a medium to form an image and a head tank to supply the liquid to the liquid discharge head.

A conveyance unit 112 serving as a conveyor to convey a recording medium (sheet) is disposed opposing the carriage unit 111. The conveyance unit 112 has a configuration of using, for example, a conveyance belt or a set of a conveyance roller and a platen member (conveyance guide).

A cartridge holder 116 is disposed at one lateral side of the apparatus body 101. Liquid cartridges 115 serving as main tanks to contain liquid supplied to the head tanks of the carriage unit 111 are removably mounted to the cartridge holder 116.

The waste liquid tank accommodation part 120 serving as a waste liquid container accommodation part is disposed below the cartridge holder 116.

A first waste liquid tank 201 illustrated in, e.g., FIG. 4 serving as a first waste liquid container to store waste liquid generated by maintenance and recovery operation is replaceably mounted to the waste liquid tank accommodation part 120.

A maintenance unit 130 to maintain and recover the condition of the liquid discharge head is disposed at one side in the main scanning direction of the carriage unit 111.

The maintenance unit 130 includes a suction pump 131 to suck and drain waste liquid generated by maintenance and recovery operation. Waste liquid sucked by the suction pump 131 is drained into the waste liquid tank accommodation part 120 through a waste liquid drain passage member 134. The waste liquid drain passage member 134 includes, for example, a tube 132 and a needle 133 serving as a waste liquid drain passage member.

In this embodiment, when the first waste liquid tank 201 is mounted in the waste liquid tank accommodation part 120, the needle 133 of the waste liquid drain passage member 134 is inserted into the first waste liquid tank 201 so that waste liquid is led and drained into the first waste liquid tank 201.

Figure 5A:
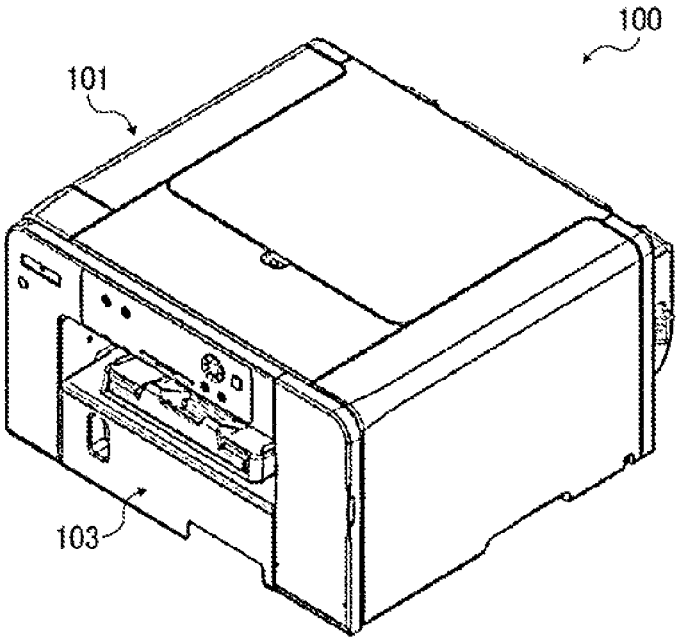
FIG. 5A is an outer perspective view of the image forming apparatus with the second waste liquid container not mounted therein.
Figure 5B:
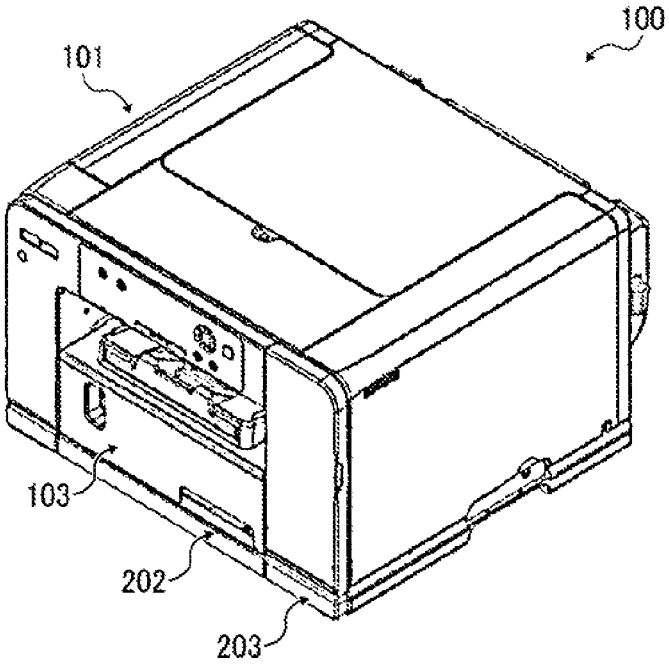
FIG. 5B is an outer perspective view of the image forming apparatus with the second waste liquid container mounted therein.
Figure 6A:
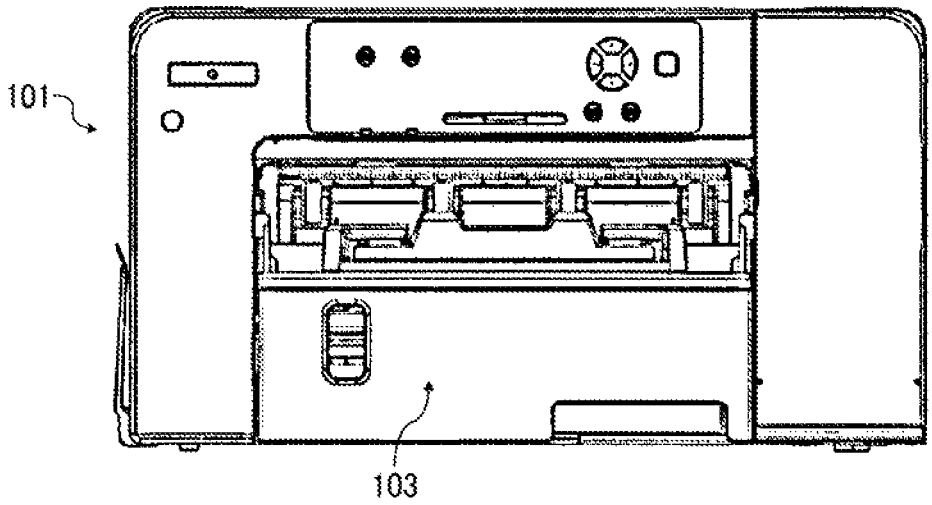
FIG. 6A is a plan view of the image forming apparatus with the second waste liquid container not mounted therein.
Figure 6B:
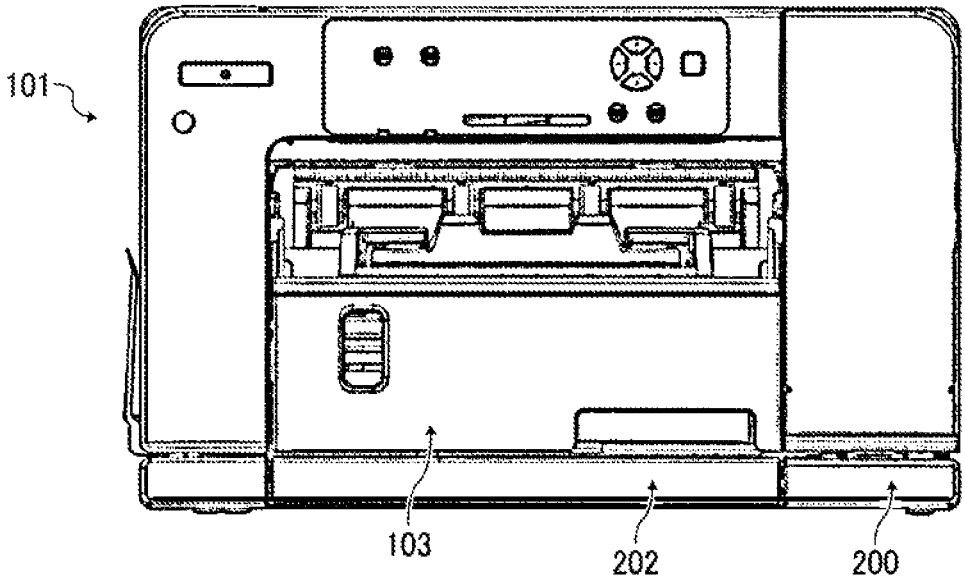
FIG. 6B is a plan view of the image forming apparatus with the second waste liquid container mounted therein.
Figure 7A:
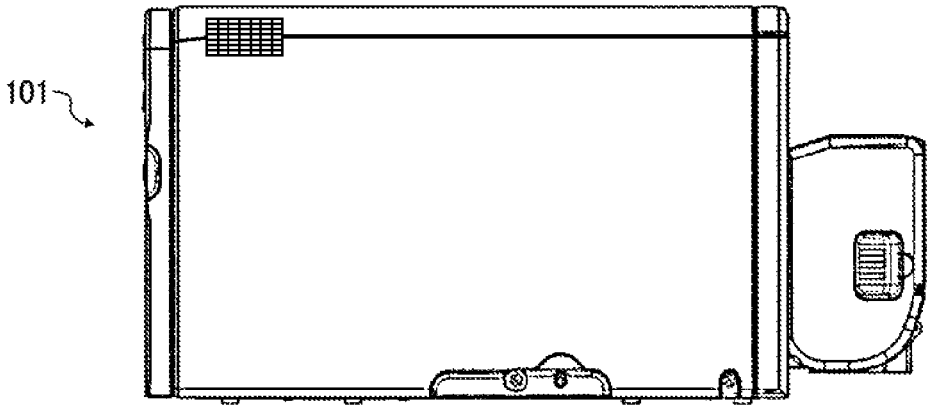
FIG. 7A is a side view of the image forming apparatus with the second waste liquid container not mounted therein.
Figure 7B:
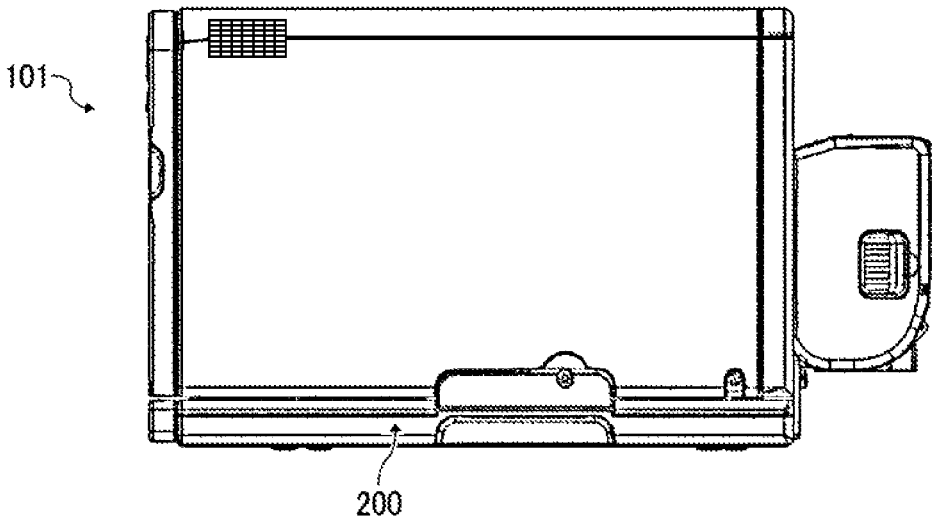
FIG. 7B is a side view of the image forming apparatus with the second waste liquid container mounted therein.
Figure 8:
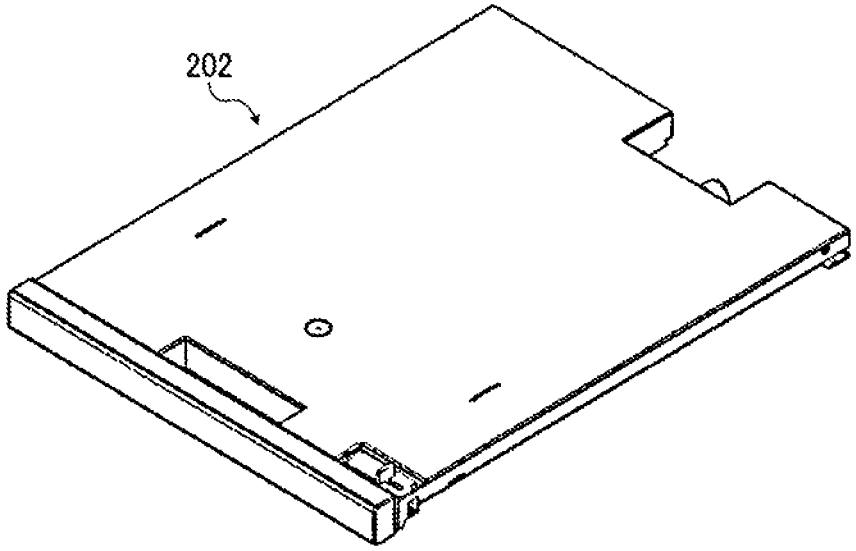
FIG. 8 is an outer perspective view of the second waste liquid container.

Next, a state in which the second waste liquid container is mounted to the image forming apparatus 100 is described with reference to FIGS. 5A, 5B, 6A, 6B, 7A, 7B and 8. FIG. 5A is an outer perspective view of the image forming apparatus 100 with the second waste liquid container not mounted therein. FIG. 5B is an outer perspective view of the image forming apparatus 100 with the second waste liquid container mounted therein. FIG. 6A is a plan view of the image forming apparatus 100 with the second waste liquid container not mounted therein. FIG. 6B is a plan view of the image forming apparatus 100 with the second waste liquid container mounted therein. FIG. 7A is a side view of the image forming apparatus 100 with the second waste liquid container not mounted therein. FIG. 7B is a side view of the image forming apparatus 100 with the second waste liquid container mounted therein. FIG. 8 is an outer perspective view of the second waste liquid container in this embodiment.

In the image forming apparatus 100, a second waste liquid tank 202 serving as a second waste liquid container larger in capacity (volume) than the first waste liquid tank 201 is mountable to a bottom portion of the apparatus body 101 that is a portion other than the waste liquid container accommodation part, in other than, a portion other than the waste liquid tank accommodation part 120.

When the second waste liquid tank 202 is mounted, a second waste liquid tank accommodation unit 200 serving as a second waste liquid container accommodation part) is mounted on a lower portion of the apparatus body 101 serving as a mount portion.

Using the second waste liquid tank 202 reduces the frequency of replacement as compared to a configuration of using the first waste liquid tank 201 or may obviate replacement until the product life of the apparatus ends.

Figure 9:
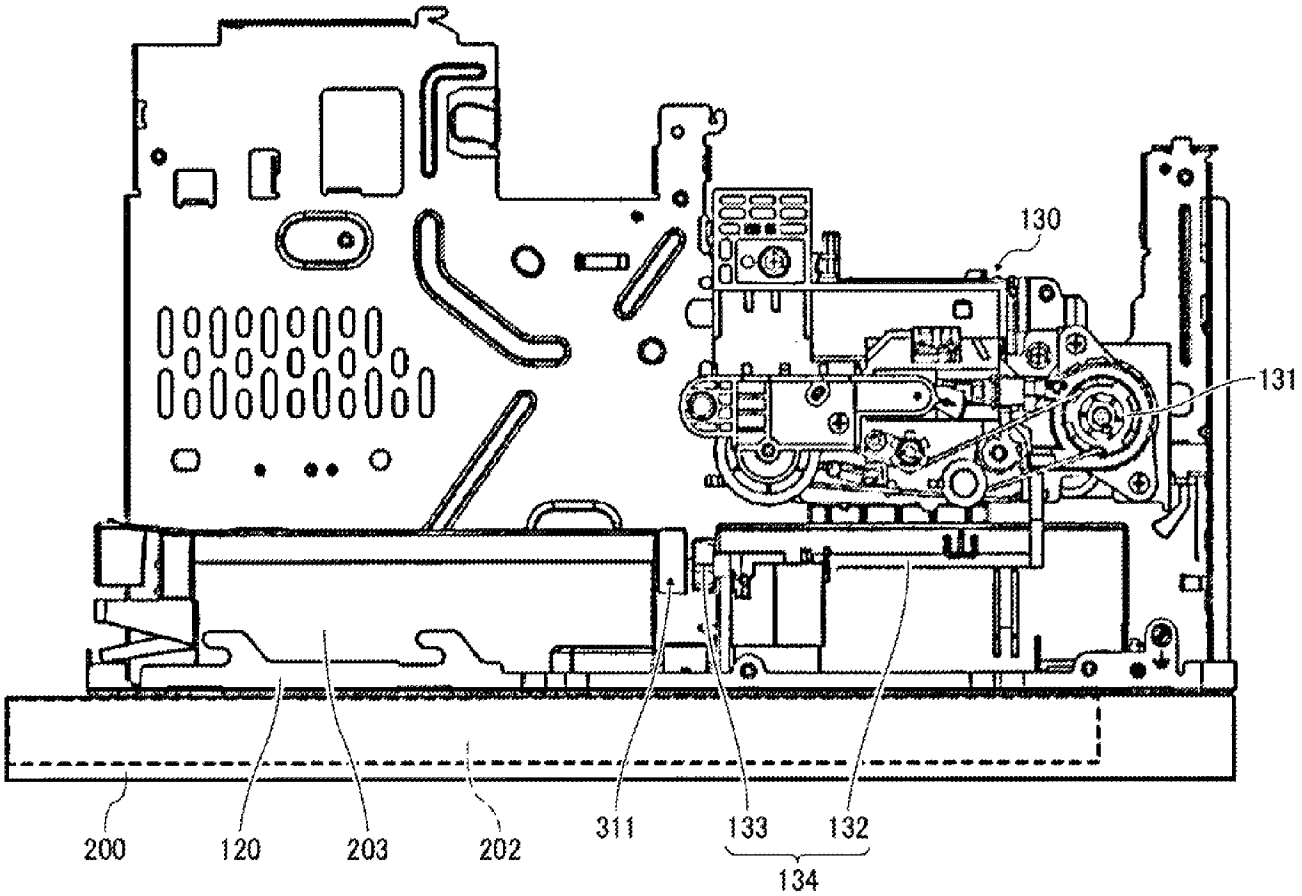
FIG. 9 is a side view of an image forming apparatus according to a first embodiment of the present disclosure.

Next, a first embodiment of the present disclosure is described with reference to FIG. 9. FIG. 9 is a side view of an image forming apparatus according to the first embodiment.

In this embodiment, the waste liquid tank accommodation part 120 of the apparatus body 101 can accommodate, instead of the first waste liquid tank 201, a relay unit 203 to relay a drain passage from the needle 133 forming the waste liquid drain passage member 134, which guides waste liquid into the waste liquid tank accommodation part 120, to the second waste liquid tank 202. The relay unit 203 is a relay unit for a waste liquid container of an image forming apparatus according to an embodiment of this disclosure.

When the second waste liquid tank accommodation unit 200 is mounted to the bottom portion of the apparatus body 101 and the second waste liquid tank 202 is mounted into the second waste liquid tank accommodation unit 200, the relay unit 203, instead of the first waste liquid tank 201, is mounted into the waste liquid tank accommodation part 120 of the apparatus body 101.

The relay unit 203 connects the waste liquid drain passage member 134 to the second waste liquid tank accommodation unit 200 forming the waste liquid drain passage connected to the second waste liquid tank 202.

As described above, in the waste liquid tank accommodation part 120 to accommodate the first waste liquid tank 201, the relay unit 203, instead of the first waste liquid tank 201, is mounted to relay connection of the waste liquid drain passage member 134 and the second waste liquid tank 202.

Such a configuration simplifies the connection of the waste liquid drain passage member 134 to the first waste liquid tank 201 having a smaller capacity and the second waste liquid tank 202 having a larger capacity mounted to different portions, that is, the waste liquid tank accommodation part 120 and the bottom portion of the apparatus body 101, respectively.

Figure 10A:
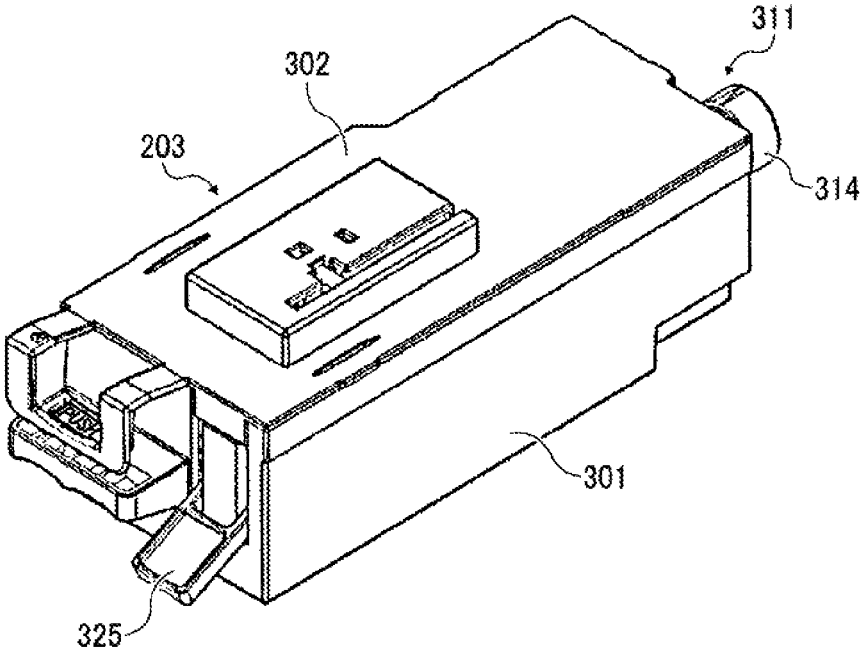
FIGS. 10A and 10B are outer perspective views of a relay unit according to an embodiment of this disclosure.
Figure 10B:
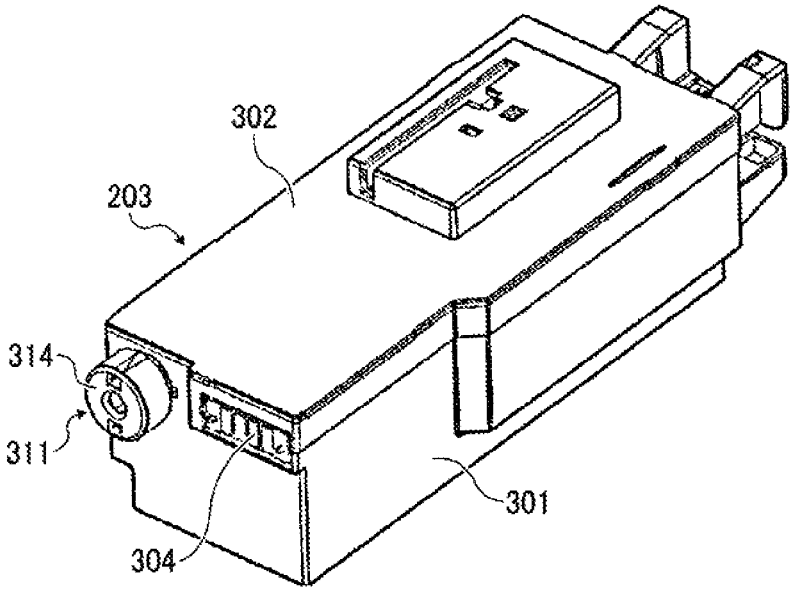
Figure 11:
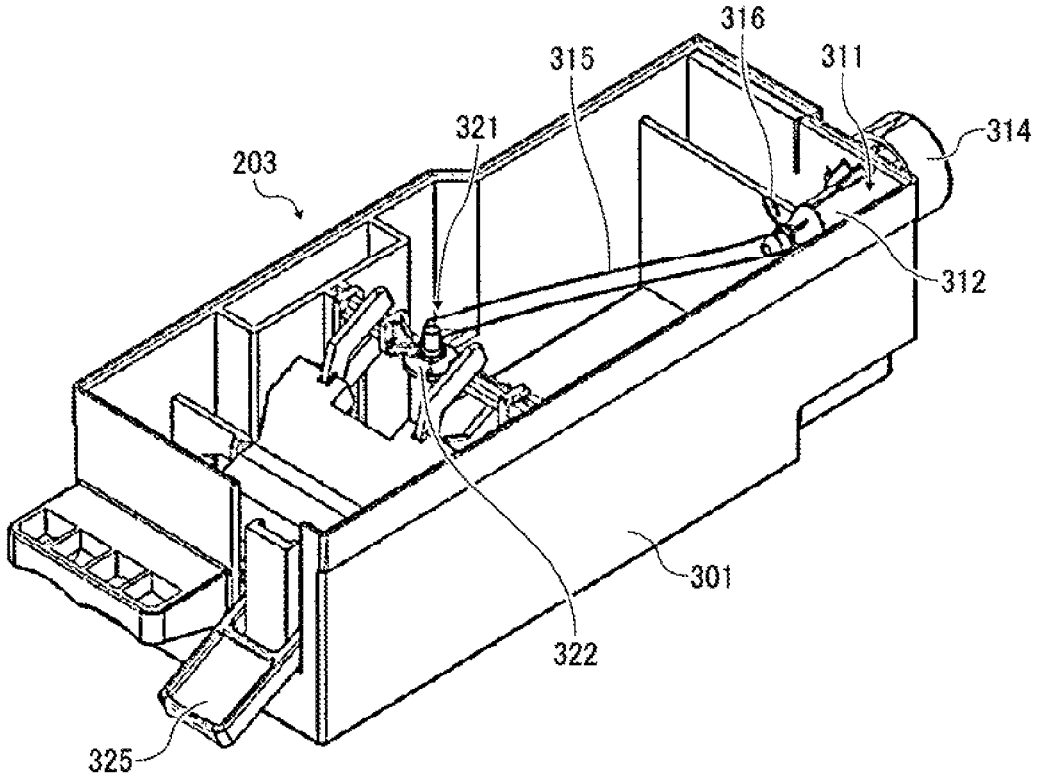
FIG. 11 is a perspective view of the relay unit with a cover removed.
Figure 12:
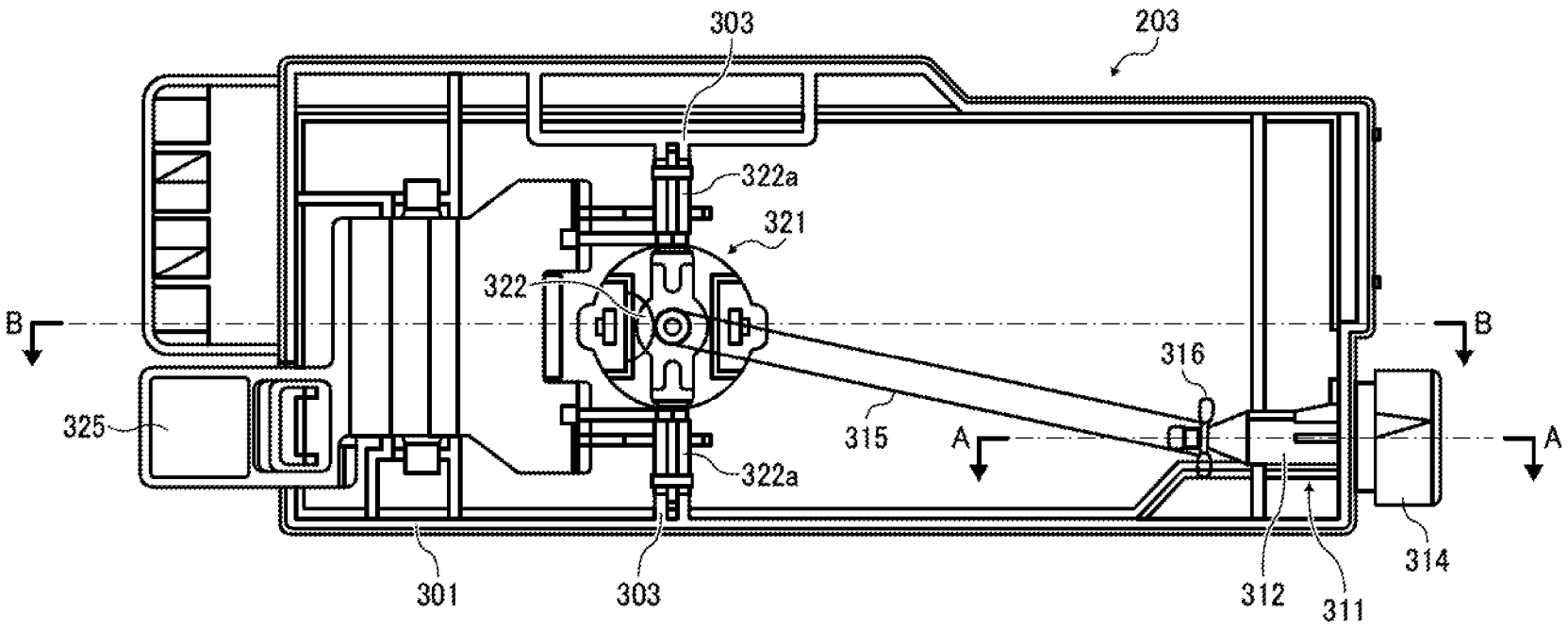
FIG. 12 is a plan view of the relay unit of FIG. 11.
Figure 13A:
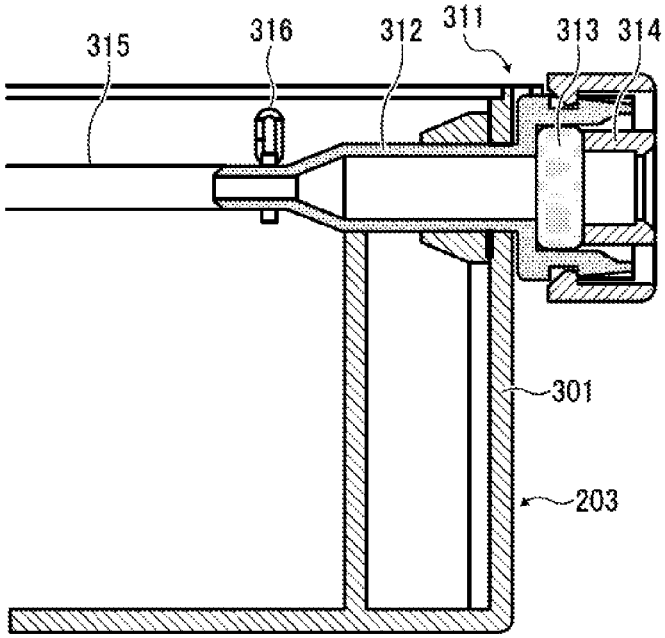
FIGS. 13A and 13B are cross-sectional views of the relay unit cut along line A-A of FIG. 12.
Figure 13B:
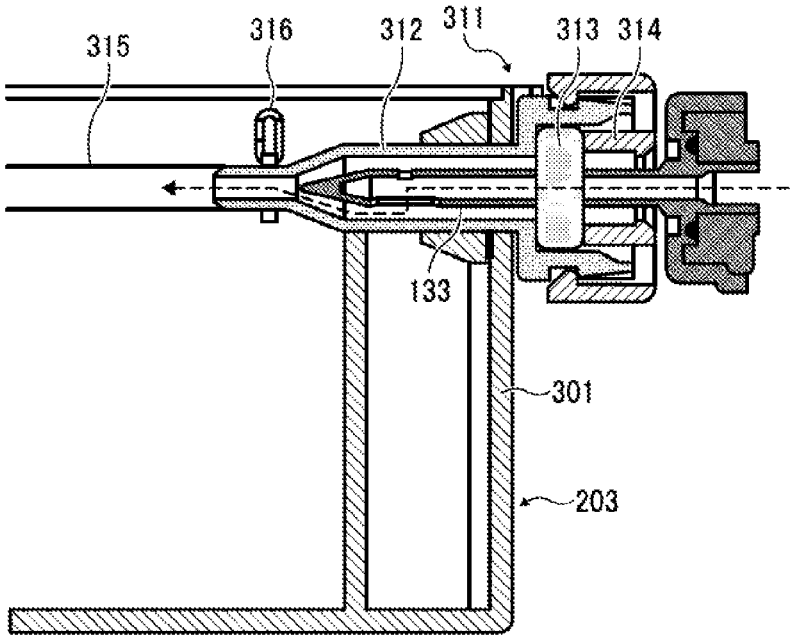
Figure 14:
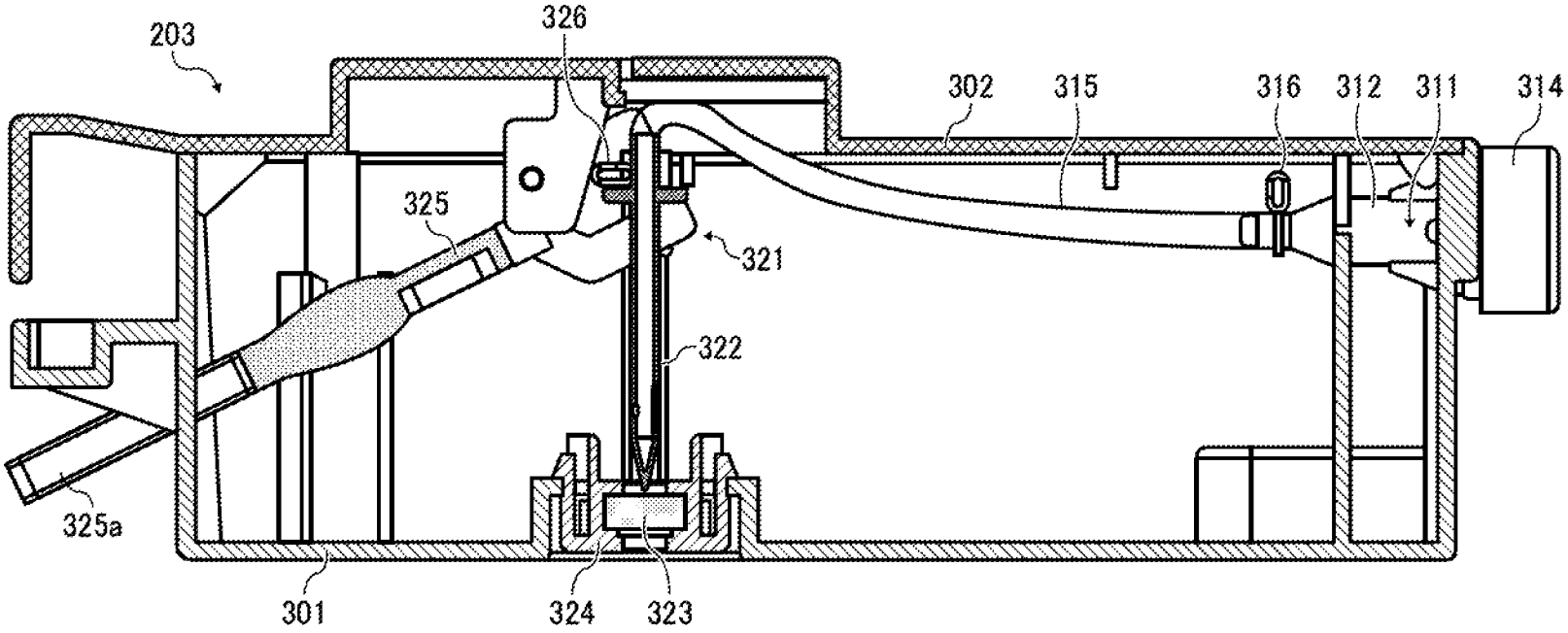
FIG. 14 is a cross-sectional view of the relay unit cut along line B-B of FIG. 12.
Figure 15A:
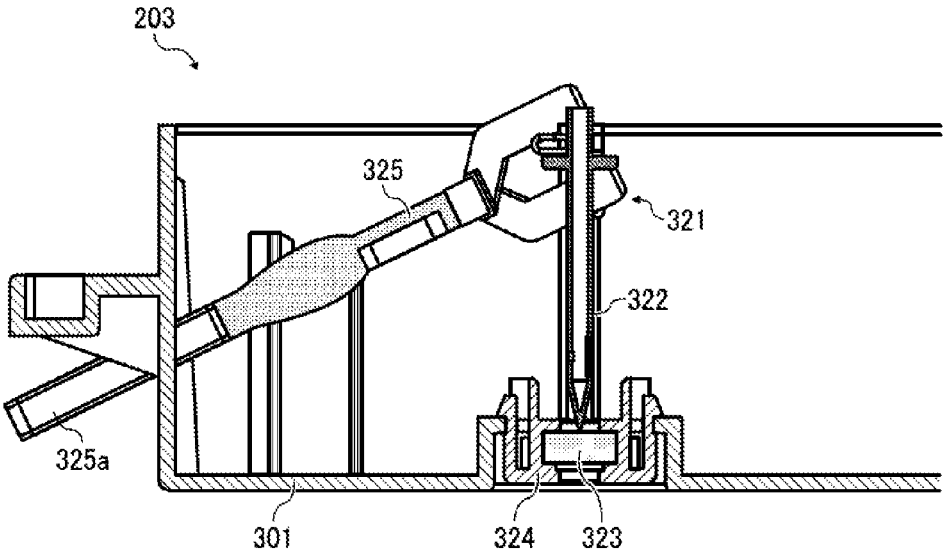
FIGS. 15A and 15B are cross-sectional views of operation of a connection lever of the relay unit of FIG. 14.
Figure 15B:
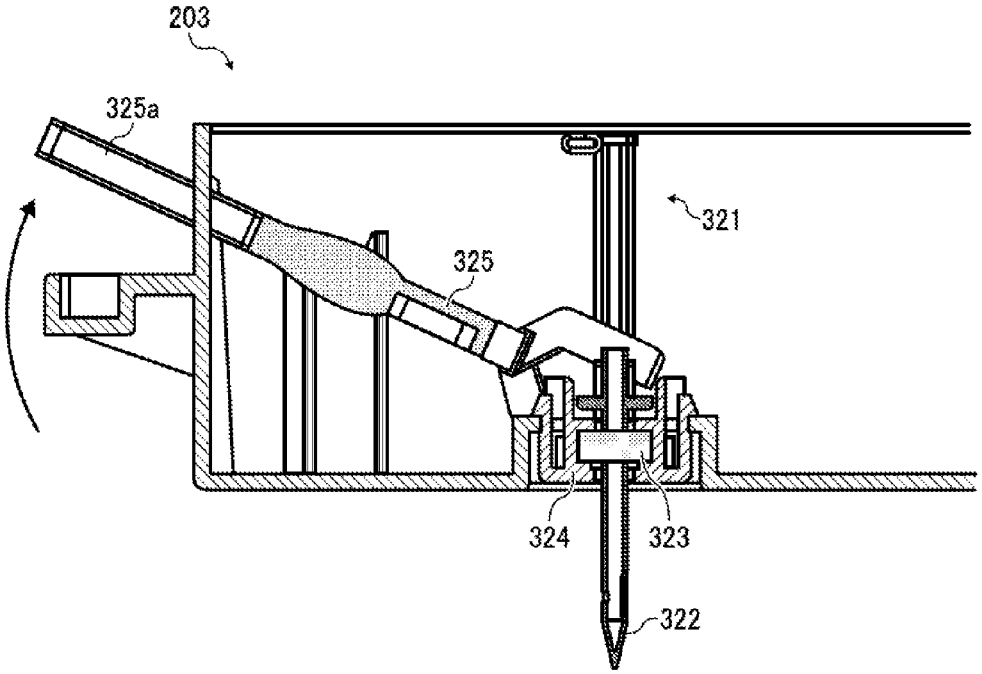

Next, a relay unit according to an embodiment of this disclosure is described with reference to FIGS. 10 through 15. FIGS. 10A and 10B are outer perspective views of a relay unit according to an embodiment of this disclosure. FIG. 11 is a perspective view of the relay unit with a cover removed. FIG. 12 is a plan view of the relay unit of FIG. 11. FIGS. 13A and 13B are cross-sectional views of the relay unit cut along line A-A of FIG. 12. FIG. 14 is a cross-sectional view of the relay unit cut along line B-B of FIG. 12. FIGS. 15A and 15B are cross-sectional views of operation of a connection lever of the relay unit of FIG. 14.

The relay unit 203 includes a box-shaped unit case (housing case) 301 and a cover 302 of the unit case 301.

In this embodiment, as illustrated in FIG. 10B, on an outer surface of the relay unit 203 at a rear side in a mounting direction thereof is disposed an information storage medium 304 to store information identifying the relay unit. By reading information from the information storage medium 304 with a component mounted at the apparatus body 101, a state in which the relay unit 203 is mounted in the waste liquid tank accommodation part 120 is recognized.

At a rear side of the unit case 301 in the mounting direction of the relay unit 203 is disposed an inflow-side joint portion 311 serving as a first connector to be connected to the needle 133 that forms the waste liquid drain passage member 134 at the apparatus body 101.

As illustrated in FIG. 12, the inflow-side joint portion 311 includes a joint 312 through which the needle 133 is inserted, a seal rubber 313, and a cap 314. When the cap 314 engages the joint 312, the seal rubber 313 is compressed to seal an upstream side of the joint 312.

One end of a tube 315 is mounted on a downstream side of the joint 312 via a retaining ring 316.

By mounting the relay unit 203 into the waste liquid tank accommodation part 120, as illustrated in FIG. 13B, the needle 133 is connected to the inside of the joint 312 via the seal rubber 313 so that waste liquid flows from the joint 312 to the tube 315.

An outflow-side joint portion 321 serving as a second connector to be connected to the second waste liquid tank accommodation unit 200 is disposed around a center of the unit case 301.

The outflow-side joint portion 321 is a connector to switch a connected state and an unconnected state of the drain passage from the needle 133 of the waste liquid drain passage member 134 serving as the waste liquid drain passage member to the second waste liquid tank 202.

In the outflow-side joint portion 321, a needle 322 connected to the inflow-side joint portion 311 via the tube 315 is held on a guide 303 disposed at the unit case 301 so as to move up and down. The tube 315 is mounted with a retaining ring 326.

A seal 323, through which the needle 322 is inserted, is held with a cap 324 at a bottom portion of the unit case 301, which is at a leading end side of the needle 322.

The needle 322 includes arms 322*a* on both lateral sides. The arms 322*a* are connected to a leading end of a connection lever 325 serving as a lever to switch connectors.

The connection lever 325 is held with the unit case 301 to be swingable upward and downward, and has a handle 325*a* projecting to the outside of the unit case 301 so as to be manually handled.

Accordingly, as illustrated in FIG. 15A, when the handle 325*a* of the connection lever 325 is lowered, the needle 322 is housed in the unit case 301 and the drain passage to the second waste liquid tank 202 is unconnected.

From this state, as illustrated in FIG. 15B, when the handle 325*a* of the connection lever 325 is raised, the needle 322 penetrates through the seal 323 and projects beyond the bottom portion of the unit case 301. As a result, the drain passage to the second waste liquid tank 202 is unconnected.

Figure 16A:
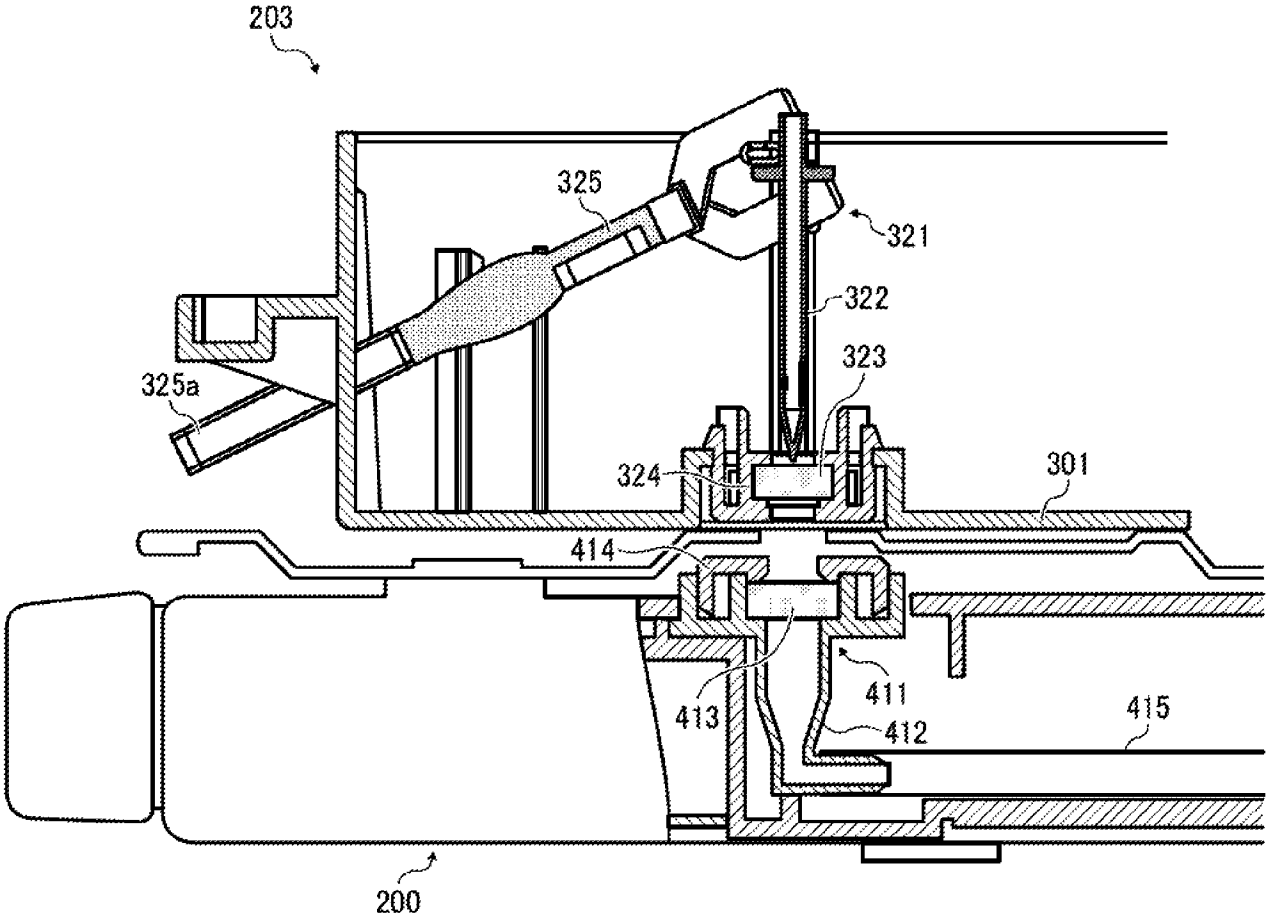
FIGS. 16A and 16B are cross-sectional views of a connecting portion of the relay unit and a second waste liquid tank accommodation unit.
Figure 16B:
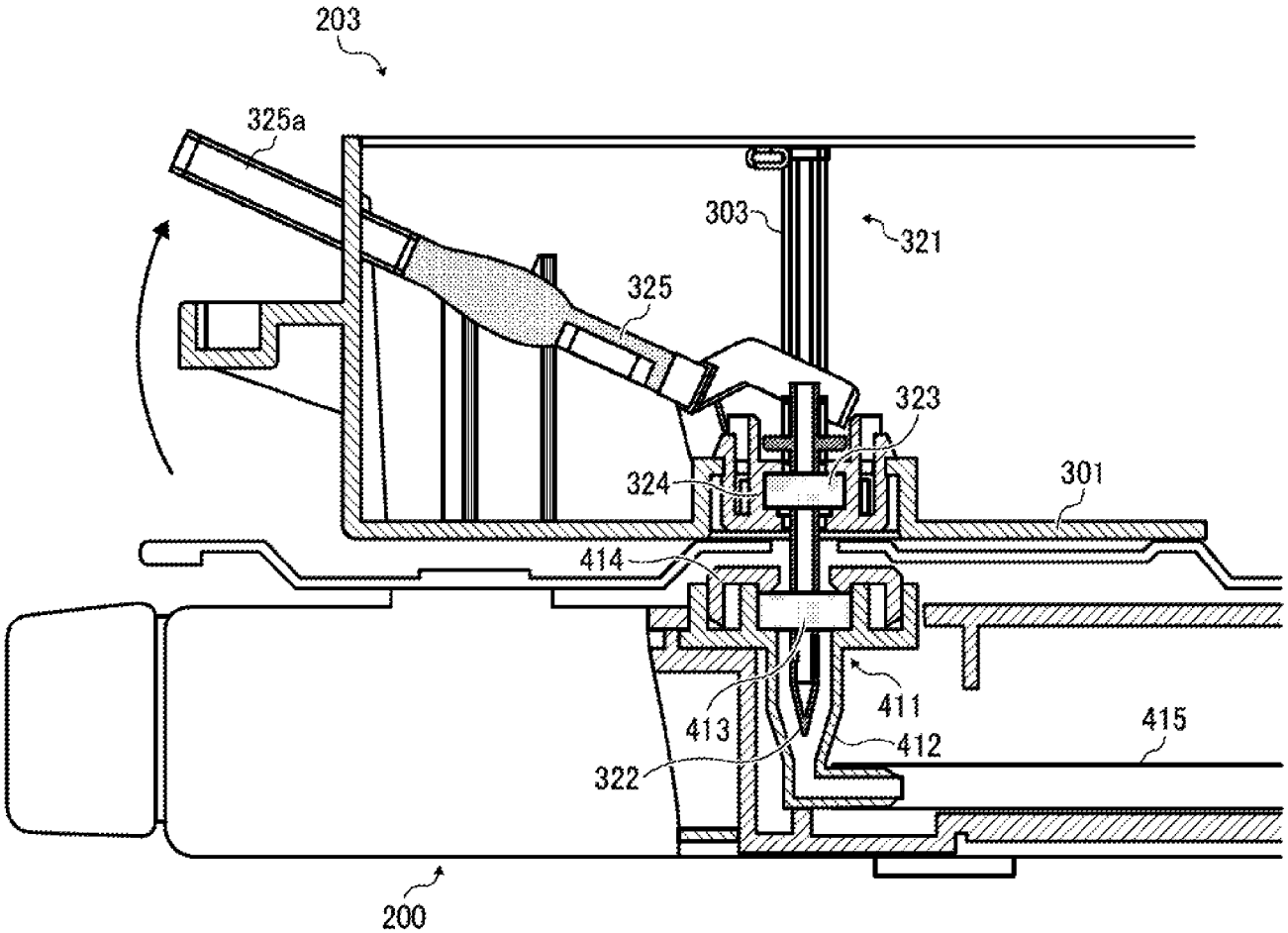

Next, a connecting portion of the relay unit 203 and the second waste liquid tank accommodation unit 200 is described with reference to FIGS. 16A and 16B. FIGS. 16A and 16B are cross-sectional views of the connecting portion.

The second waste liquid tank accommodation unit 200 includes an inflow-side joint portion 411 to be connected to the needle 322 of the relay unit 203.

The inflow-side joint portion 411 includes a joint 412 into which the needle 322 is inserted, a seal rubber 413, and a cap 414. When the cap 414 fits in the joint 412, the seal rubber 413 is compressed to seal an upstream portion of the joint 412.

One end of a tube 415 is mounted on a downstream side of the joint 412 with a retaining ring. The other end of the tube 415 is connected to an outflow-side joint portion 421 to be connected to the second waste liquid tank 202.

With such a configuration, as illustrated in FIG. 16A, when the handle 325*a* of the connection lever 325 is lowered, the needle 322 is housed in the unit case 301. Accordingly, the needle 322 of the relay unit 203 is not connected to the joint 412 of the second waste liquid tank accommodation unit 200, and the drain passage to the second waste liquid tank 202 is unconnected.

From this state, as illustrated in FIG. 16B, when the handle 325*a* of the connection lever 325 is raised, the needle 322 penetrates through the seal 323 and projects beyond the bottom portion of the unit case 301.

Thus, the needle 322 of the relay unit 203 is connected to the joint 412 of the second waste liquid tank accommodation unit 200, and the drain passage is connected.

As described above, handling the connection lever 325 allows switching the connection of the outflow-side joint portion 321 and the inflow-side joint portion 411 of the second waste liquid tank accommodation unit 200, which serve as connectors, between the connected state and the unconnected state.

Figure 17:
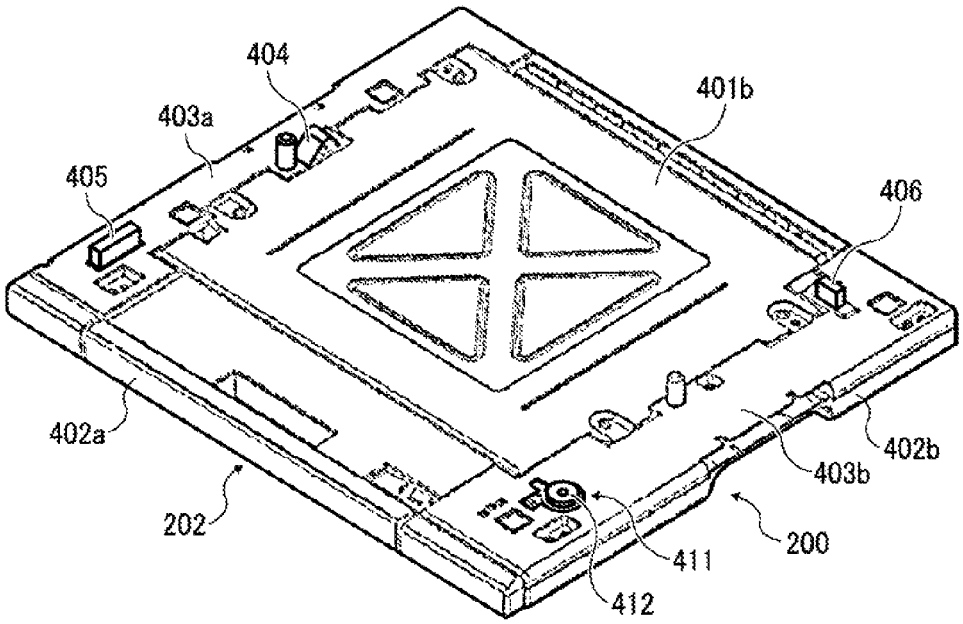
FIG. 17 is a perspective view of a state in which a second waste liquid tank is accommodated in the second waste liquid tank accommodation unit.
Figure 18:
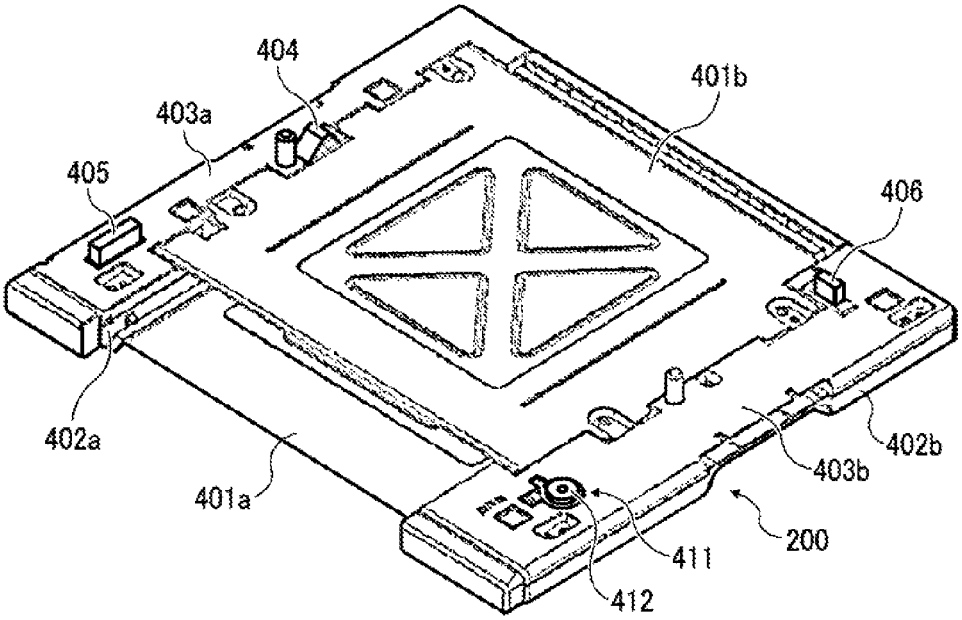
FIG. 18 is a perspective view of a state in which the second waste liquid tank is not accommodated in the second waste liquid tank accommodation unit.
Figure 19:
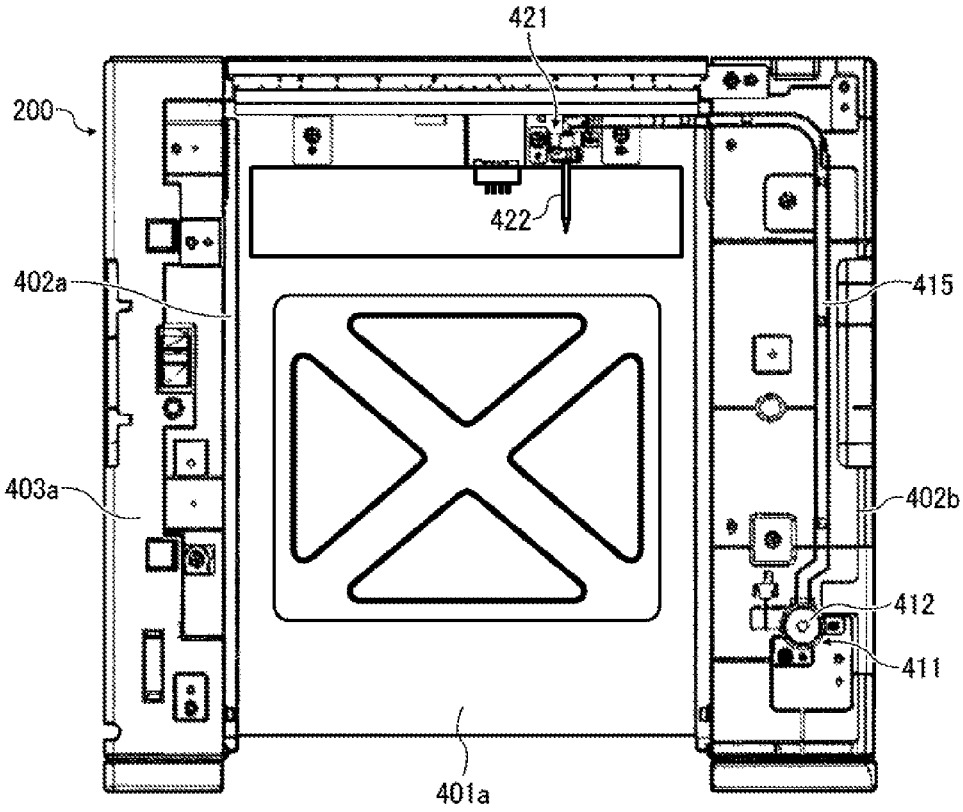
FIG. 19 is a plan view of an accommodation part of the second waste liquid tank accommodation unit.
Figure 20:
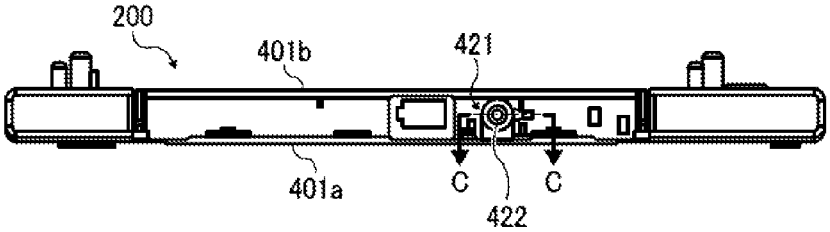
FIG. 20 is a front view of the accommodation part of FIG. 19.
Figure 21:
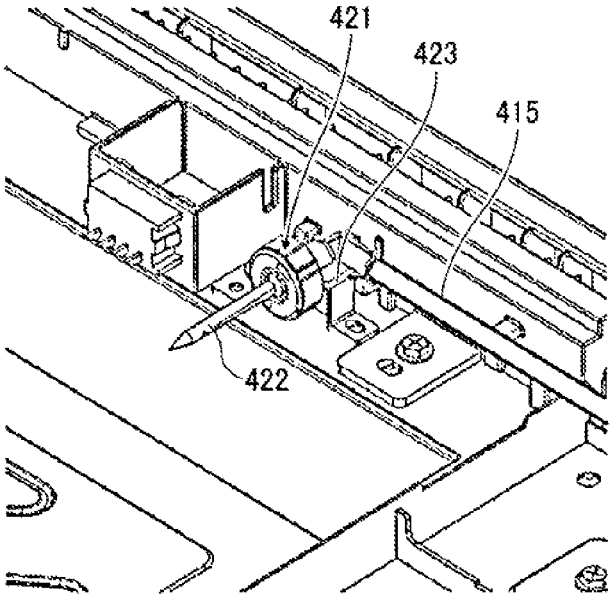
FIG. 21 is an enlarged perspective view of an outflow-side joint portion of the second waste liquid tank accommodation unit.
Figure 22:
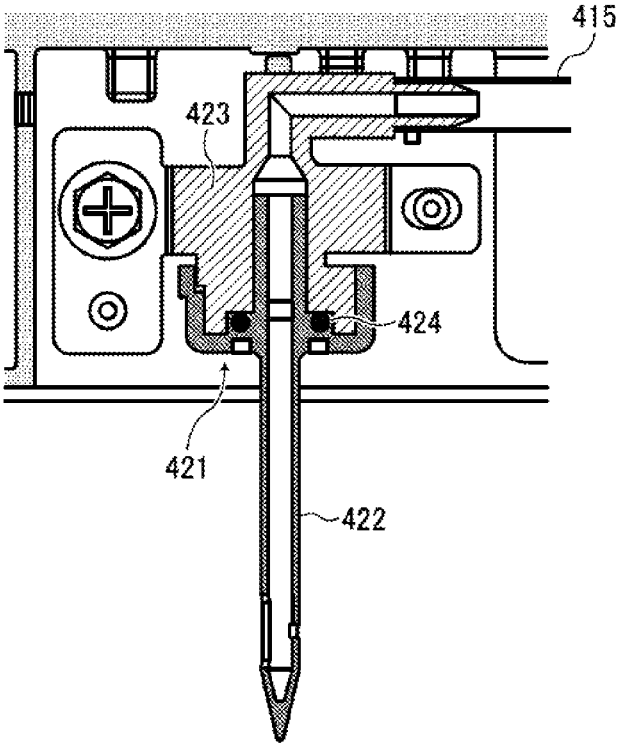
FIG. 22 is a cross-sectional view of the outflow-side joint portion cut along line C-C of FIG. 20.

Next, an example pf the second waste liquid tank accommodation unit is described with reference to FIGS. 17 through 22. FIG. 17 is a perspective view of a state in which a second waste liquid tank is accommodated in the second waste liquid tank accommodation unit. FIG. 18 is a perspective view of a state in which the second waste liquid tank is not accommodated in the second waste liquid tank accommodation unit. FIG. 19 is a plan view of an accommodation part of the second waste liquid tank accommodation unit. FIG. 20 is a front view of the accommodation part of FIG. 19. FIG. 21 is an enlarged perspective view of an outflow-side joint portion of the second waste liquid tank accommodation unit. FIG. 22 is a cross-sectional view of the outflow-side joint portion cut along line C-C of FIG. 20.

The second waste liquid tank accommodation unit 200 includes a lower base 401*a*, an upper base 401*b*, a left cover 402*a*, and a right cover 402*b*. An upper left cover 403*a* and an upper right cover 403*b* are mounted on the left cover 402*a* and the right cover 402*b*.

The second waste liquid tank accommodation unit 200 further includes an earth plate 404 for static protection and connectors 405 and 406 to connect the image forming apparatus and sensors.

At a rear side of the second waste liquid tank accommodation unit 200 in the mounting direction of the second waste liquid tank 202 is disposed an outflow-side joint portion 421 to be connected to an inflow-side joint portion 411 via a tube 415.

The outflow-side joint portion 421 includes a needle 422. The needle 422 is held with a bracket 423 mounted on the lower base 401*a*, and the bracket 423 and the needle 422 compresses a packing 424 to prevent leakage of liquid.

Figure 23:
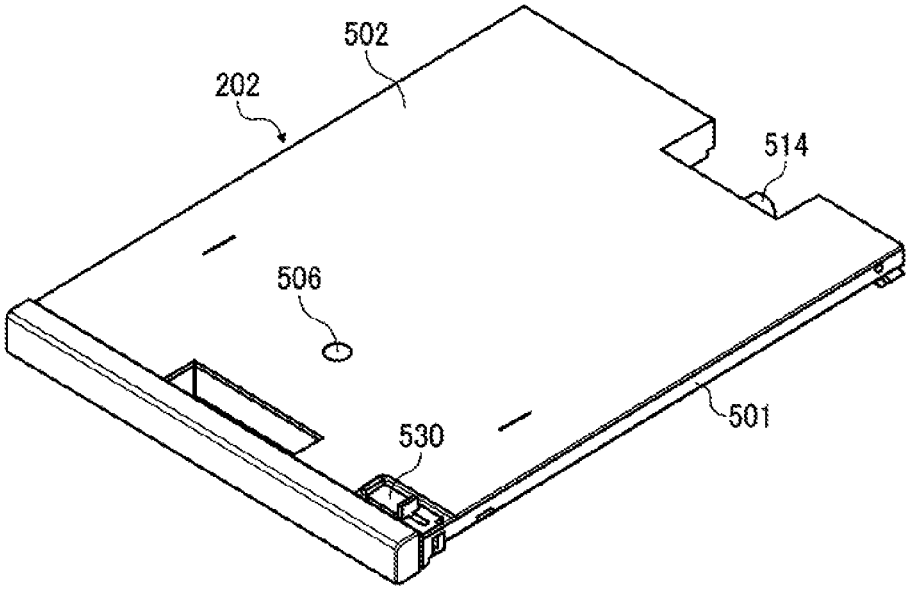
FIG. 23 is an outer perspective view of the second waste liquid tank.
Figure 24:
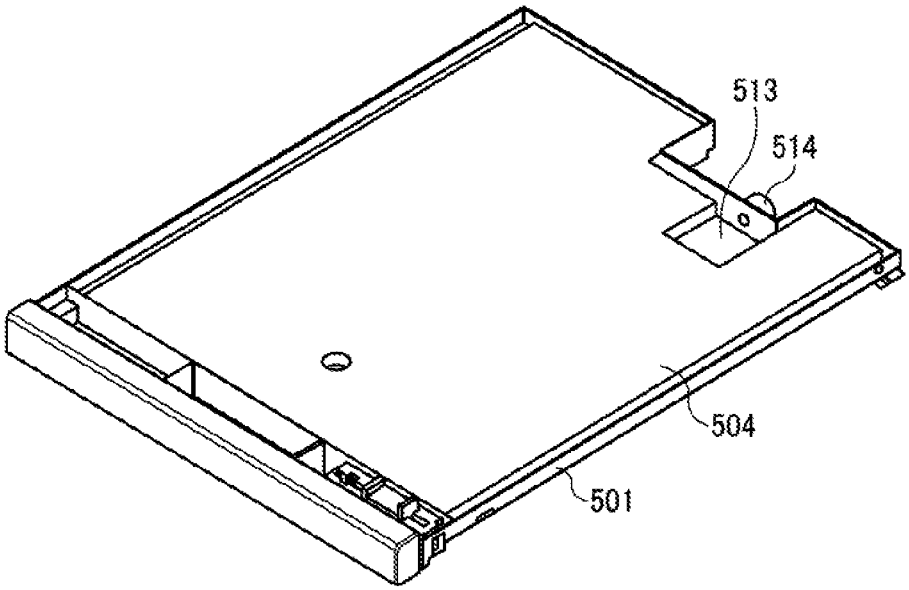
FIG. 24 is a perspective view of the second waste liquid tank with a cover removed.
Figure 25:
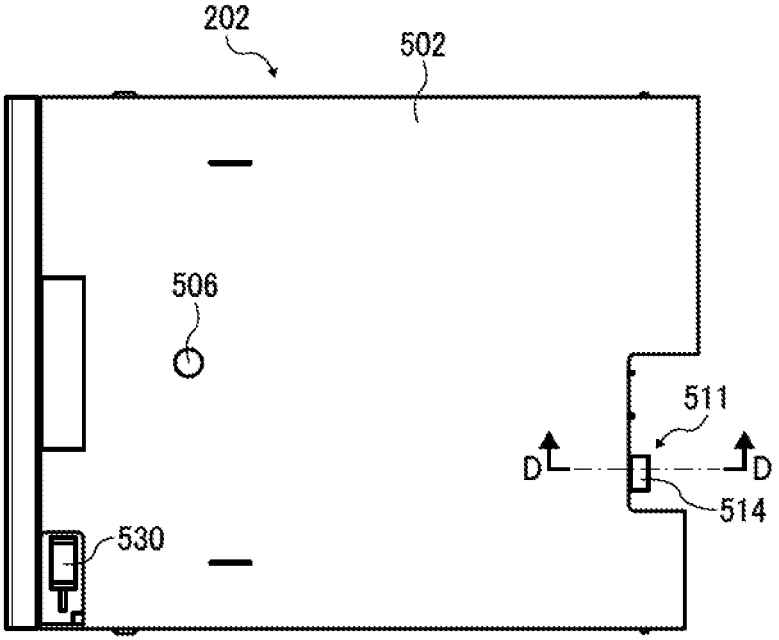
FIG. 25 is a plan view of the second waste liquid tank of FIG. 24.

Next, an example of the second waste liquid tank is described with reference to FIGS. 23 through 25 and FIGS. 26A and 26B. FIG. 23 is an outer perspective view of the second waste liquid tank. FIG. 24 is a perspective view of the second waste liquid tank with a cover removed. FIG. 25 is a plan view of the second waste liquid tank of FIG. 24.

Figure 26A:
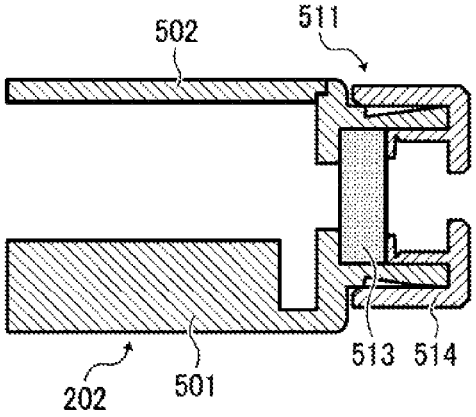
FIGS. 26A and 26B are cross-sectional views of the relay unit cut along line D-D of FIG. 25.
Figure 26B:
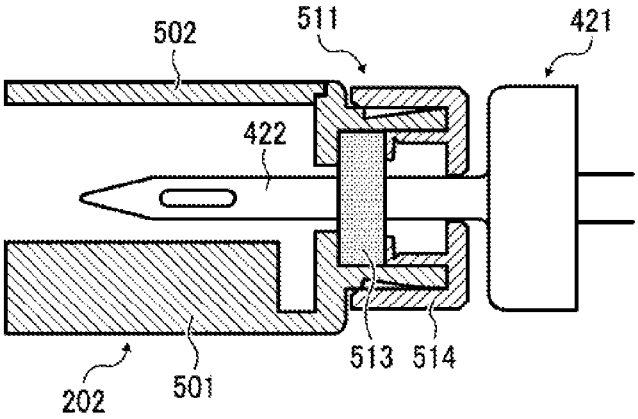

FIGS. 26A and 26B are cross-sectional views of the relay unit cut along line D-D of FIG. 25.

In this example, the second waste liquid tank 202 includes a box-shaped tank case (housing case) 501 and a cover 502 of the tank case 501. The second waste liquid tank 202 further includes absorbers 503 and 504 to absorb waste liquid. The cover 502 has an air release port 506.

At a rear side of the tank case 501 in a mounting direction of the second waste liquid tank 202 is disposed an inflow-side joint portion 511 to be connected to the needle 422 of the outflow-side joint portion 421 of the second waste liquid tank accommodation unit 200.

In the inflow-side joint portion 511, as illustrated in FIGS. 26A and 26B, a seal rubber 513, through which the needle 422 is inserted, is compressed and held with a cap 514 that fits in the tank case 501.

Accordingly, when the second waste liquid tank 202 is mounted to the second waste liquid tank accommodation unit 200, as illustrated in FIG. 26B, the needle 422 penetrates through the seal rubber 513 to communicate the interior of the second waste liquid tank 202 with the drain passage.

As described above, waste liquid drained through the waste liquid drain passage member 134 of the apparatus body 101 is drained into the second waste liquid tank 202 via the relay unit 203 and the second waste liquid tank accommodation unit 200 and absorbed and retained in the absorbers 503 and 504.

Figure 27:
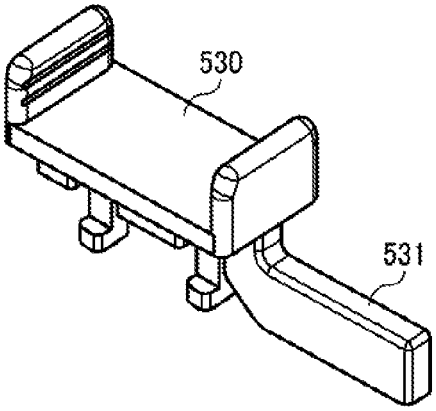
FIG. 27 is a perspective view of a lock lever of a lock assembly of locking the second waste liquid tank to the second waste liquid tank accommodation unit.
Figure 28B:
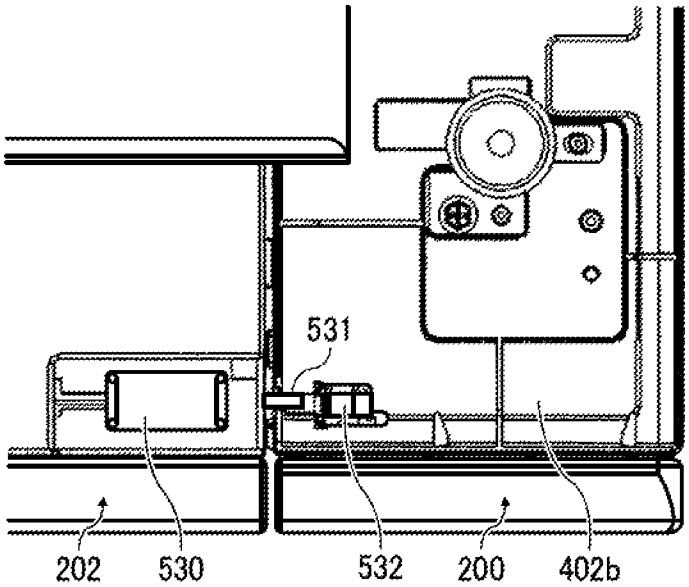
FIGS. 28A and 28B are plan views of the lock assembly.
Figure 28A:
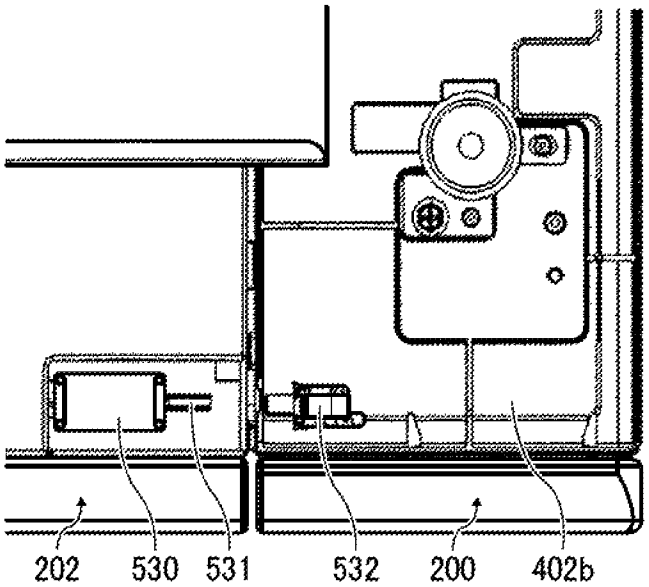

Next, an example of a lock assembly of the second waste liquid tank relative to the second waste liquid tank accommodation unit is described with reference to FIGS. 27 and 28A and 28B. FIG. 27 is a perspective view of a lock lever of the lock assembly in this example. FIGS. 28A and 28B are plan views of the lock assembly.

In the tank case 501, a lock lever 530 is disposed to be movable. The lock lever 530 is movable between an unlock position illustrated in FIG. 28A and a lock position illustrated in FIG. 28B.

When the lock lever 530 is placed in the lock position, a stopper 531 penetrates into the right cover 402*b* of the second waste liquid tank accommodation unit 200, thus preventing the second waste liquid tank 202 to be removed from the second waste liquid tank accommodation unit 200.

In this example, the second waste liquid tank 202 includes a lock sensor 532 to detect the stopper 531 of the lock lever 530. When the second waste liquid tank 202 is locked, the lock sensor 532 is pushed by the stopper 531 and thus detects that the second waste liquid tank 202 is locked.

Figure 29A:
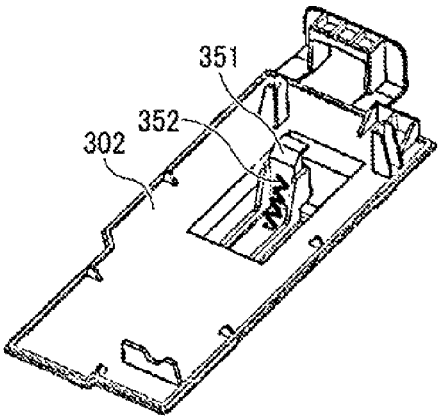
FIGS. 29A and 29B are perspective views of a cover of a relay unit according to a second embodiment of this disclosure.
Figure 29B:
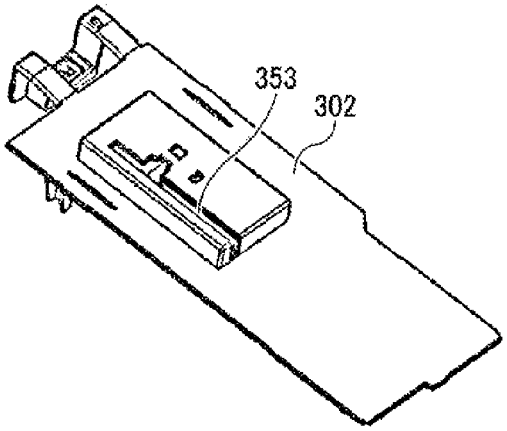
Figure 30:
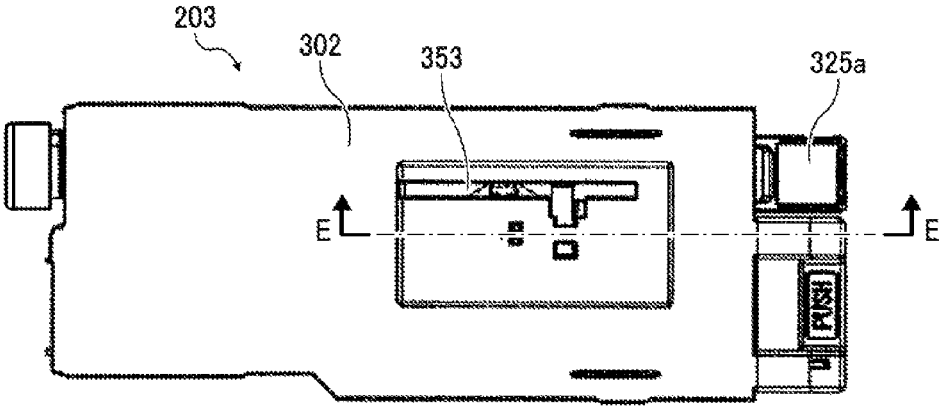
FIG. 30 is a plan view of the relay unit of FIGS. 29A and 29B.
Figure 31:
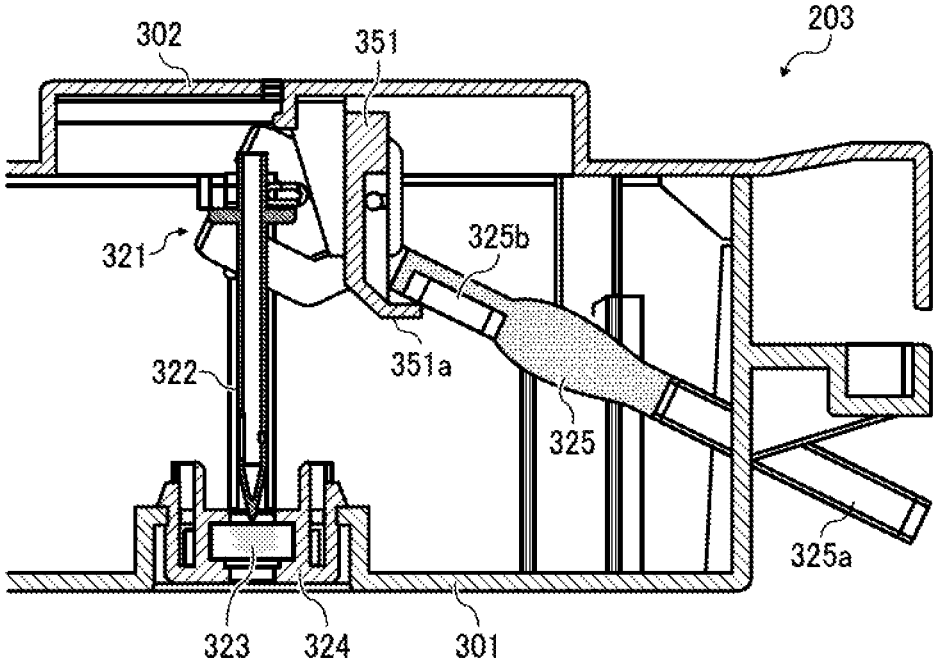
FIG. 31 is a cross-sectional view of the relay unit cut along line E-E of FIG. 31.
Figure 32A:
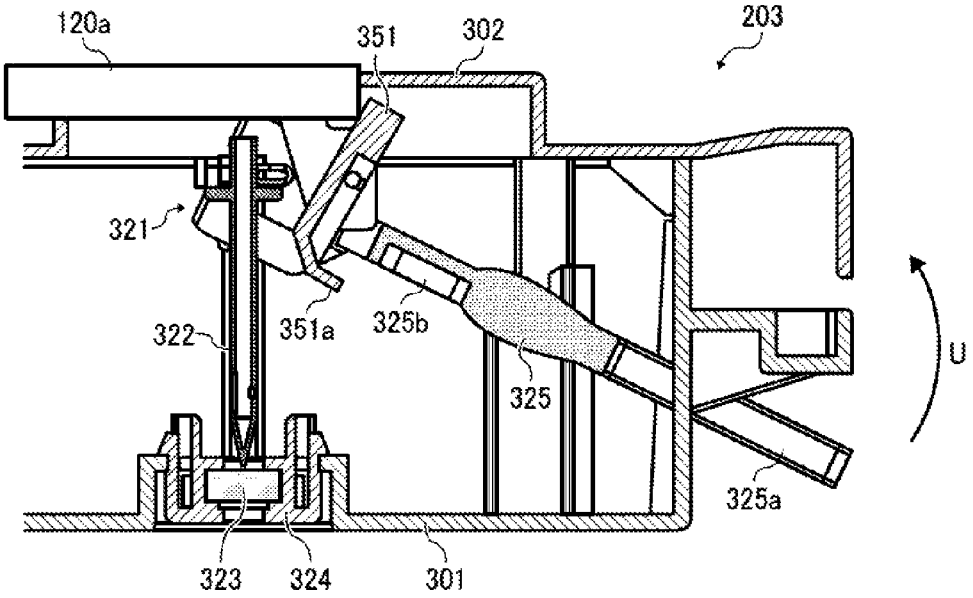
FIGS. 32A and 32B are cross-sectional views of the relay unit of FIG. 31 in operation.
Figure 32B:
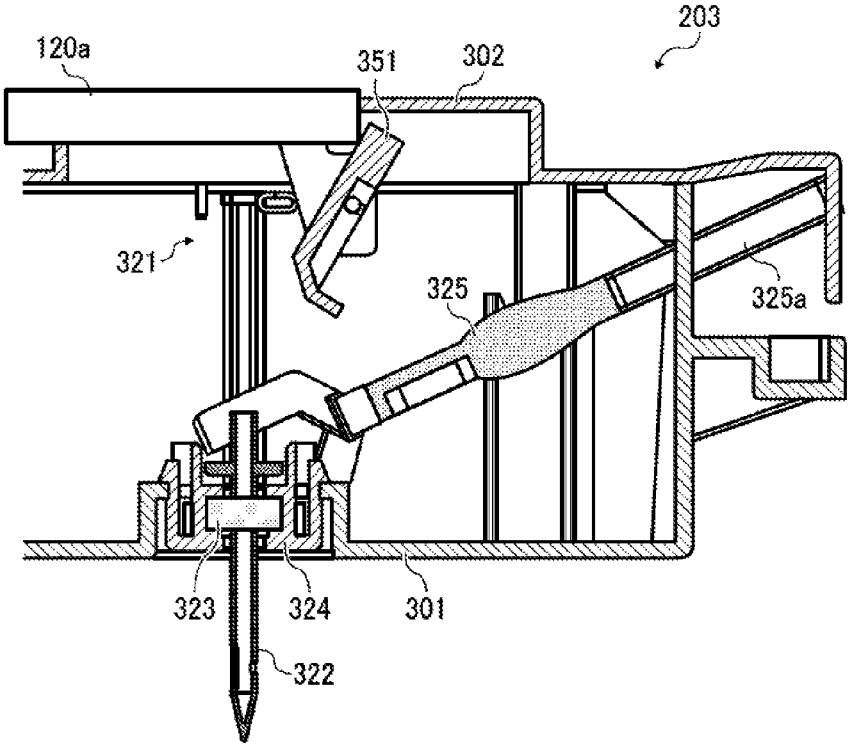

Next, a second embodiment of the present disclosure is described with reference to FIGS. 29A, 29B, 30, 31, 32A, and 32B. FIGS. 29A and 29B are perspective views of a cover of a relay unit according to the second embodiment of this disclosure. FIG. 30 is a plan view of the relay unit of FIGS. 29A and 29B. FIG. 31 is a cross-sectional view of the relay unit cut along line E-E of FIG. 31. FIGS. 32A and 32B are cross-sectional views of the relay unit of FIG. 31 in operation.

At a back face side (internal side) of a cover 302 of a relay unit 203 according to this embodiment, a lock 351 to engage a claw 325*b* of a connection lever 325 for locking is held to be rotatable. The lock 351 for the connection lever 325 is urged with a spring 352 toward a lock position.

The cover 302 includes a slit 353 to receive a rib 120*a* of the waste liquid tank accommodation part 120.

With such a configuration, when the relay unit 203 is not inserted into the waste liquid tank accommodation part 120, as illustrated in FIG. 31, a claw 351*a* of the lock 351 engages the claw 325*b* of the connection lever 325. In this state, the handle 325*a* of the connection lever 325 cannot be raised.

When the relay unit 203 is inserted into the waste liquid tank accommodation part 120, as illustrated in FIG. 32A, the lock 351 is pushed by the rib 120*a* of the waste liquid tank accommodation part 120 and rotated clockwise in FIG. 31.

Accordingly, the claw 351*a* of the lock 351 detaches from the claw 325*b* of the connection lever 325, thus allowing the handle 325*a* of the connection lever 325 to be raised in a direction indicated by arrow U in FIG. 32A.

Then, as illustrated in FIG. 32B, the handle 325*a* of the connection lever 325 is raised and the outflow-side joint portion 321 is connected.

As described above, the connection lever 325 of the relay unit 203 cannot be moved unless the relay unit 203 is mounted to the waste liquid tank accommodation part 120, thus preventing a user to accidentally handle the connection lever 325 of the relay unit 203.

Figure 33:
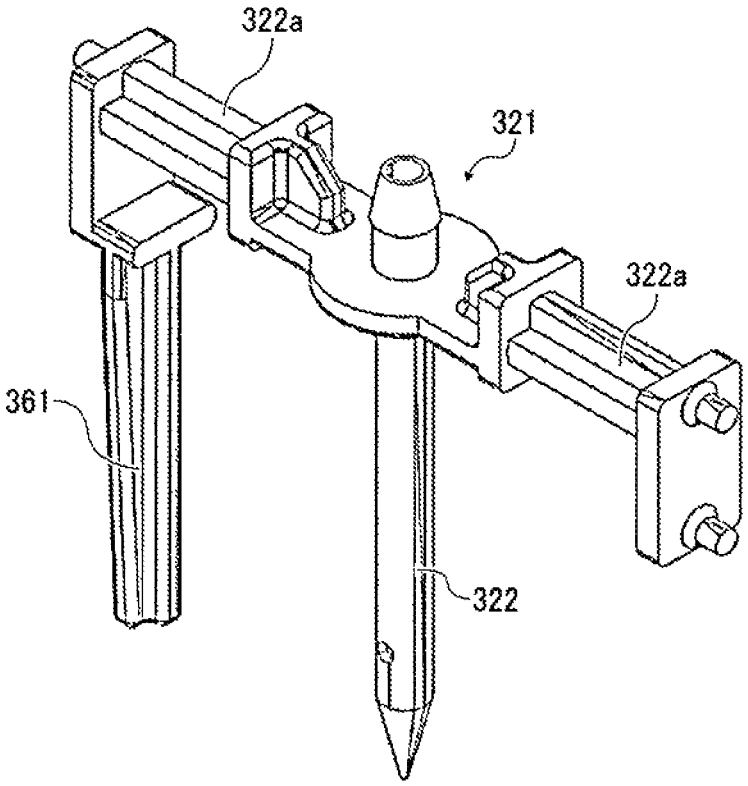
FIG. 33 is an outer perspective view of a needle of an outflow-side joint portion of a relay unit in a third embodiment of this disclosure.
Figure 34A:
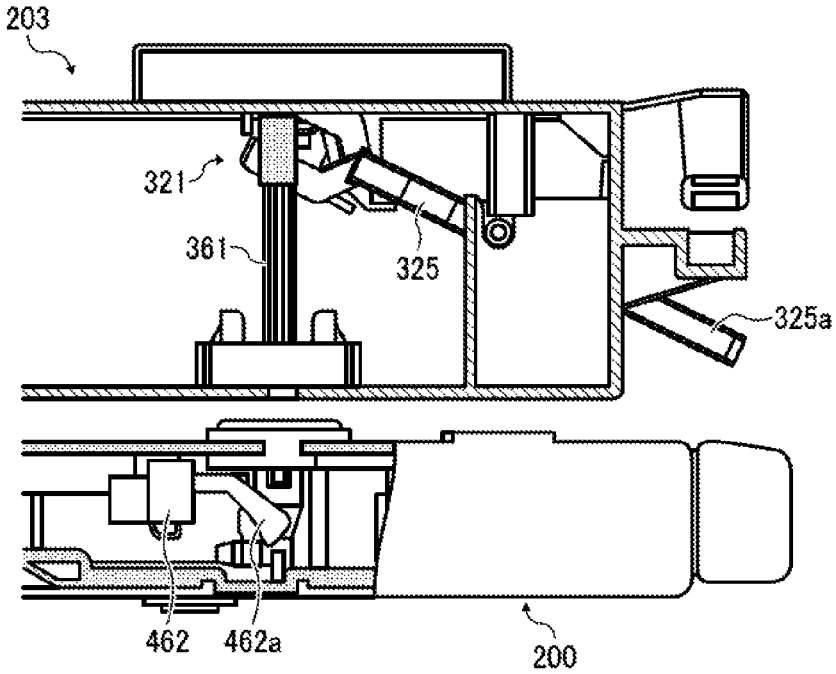
FIGS. 34A and 34B are cross-sectional views of a connecting portion of the relay unit and a second waste liquid tank accommodation unit.
Figure 34B:
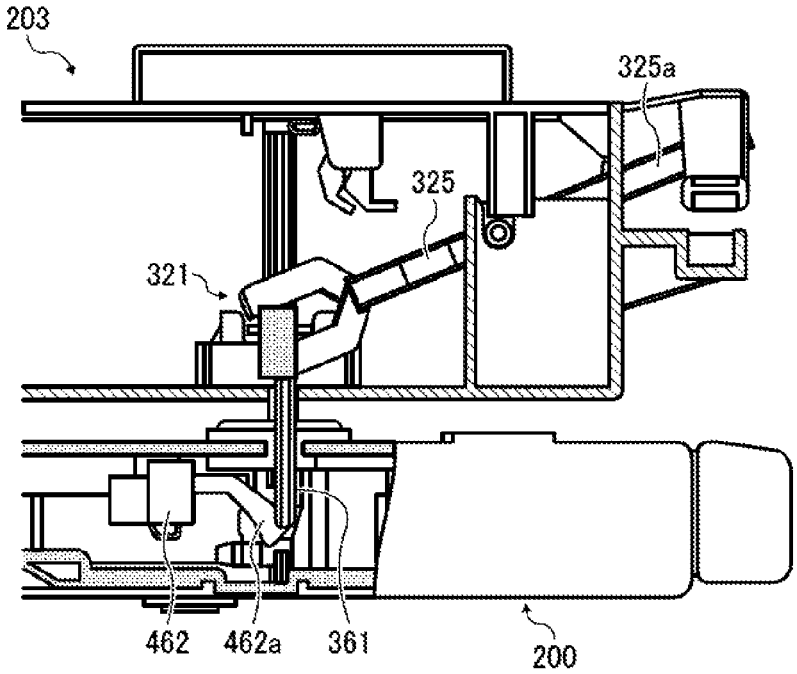

Next, a third embodiment of this disclosure is described with reference to FIGS. 33, 34A, and 34B. FIG. 33 is an outer perspective view of a needle of an outflow-side joint portion of a relay unit in the third embodiment of this disclosure. FIGS. 34A and 34B are cross-sectional views of a connecting portion of the relay unit and a second waste liquid tank accommodation unit.

A needle 322 of an outflow-side joint portion 321 of a relay unit 203 has one of arms 322*a* with a sensor detection rib 361.

A second waste liquid tank accommodation unit 200 includes a connection sensor 462 activated by the sensor detection rib 361 of the relay unit 203.

With such a configuration, as illustrated in FIG. 34A, when the needle 322 is housed in the relay unit 203 and not connected to the inflow-side joint portion 411 of the second waste liquid tank accommodation unit 200, the connection sensor 462 does not detect the sensor detection rib 361.

From such a state, as illustrated in FIG. 34B, when the needle 322 of the outflow-side joint portion 321 of the relay unit 203 is projected from the relay unit 203, the sensor detection rib 361 also projects into the second waste liquid tank accommodation unit 200. Accordingly, the sensor detection rib 361 pushes down a detection piece 462*a* of the connection sensor 462, thus turning the connection sensor 462 to ON state.

As described above, detecting the state of the connection sensor 462 allows determination of whether the relay unit 203 is connected to the second waste liquid tank accommodation unit 200 or not, thus preventing leakage of liquid due to use of the image forming apparatus in an unconnected state.

Figure 35A:
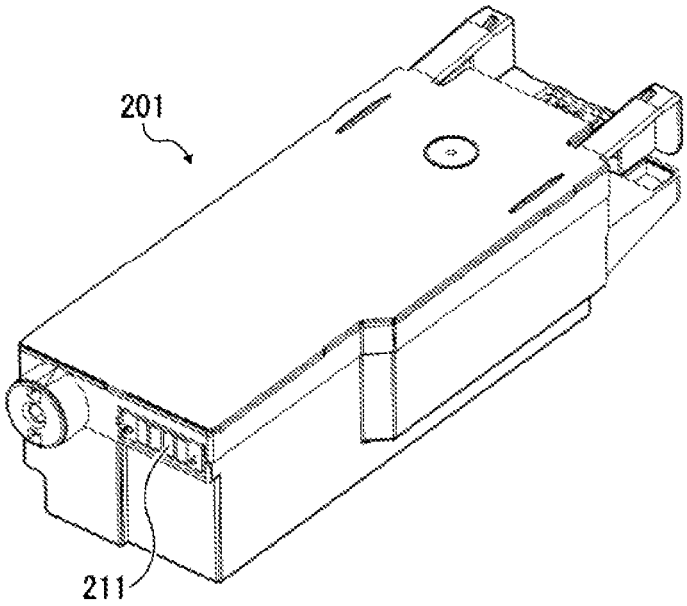
FIGS. 35A and 35B are outer perspective views of a first waste liquid tank and a relay unit in a fourth embodiment of this disclosure.
Figure 35B:
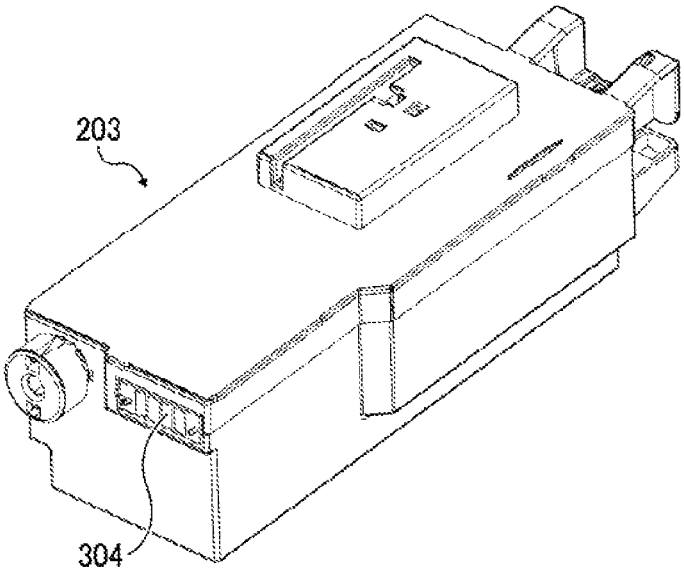

Next, a fourth embodiment of this disclosure is described with reference to FIGS. 35A and 35B. FIGS. 35A and 35B are outer perspective views of a first waste liquid tank and a relay unit in the fourth embodiment.

A first waste liquid tank 201 in this embodiment includes a first information storage medium 211. A relay unit 203 in this embodiment includes a second information storage medium 304 serving as a second information storage medium.

The first information storage medium 211 of the first waste liquid tank 201 and the second information storage medium 304 of the relay unit 203 store different pieces of information.

Thus, even if any of the first waste liquid tank 201 and the relay unit 203 is inserted into the waste liquid tank accommodation part 120, such a configuration allows determining which of the first waste liquid tank 201 and the relay unit 203 is inserted into the waste liquid tank accommodation part 120, by reading information stored in the first information storage medium 211 and the second information storage medium 304.

Figure 36:
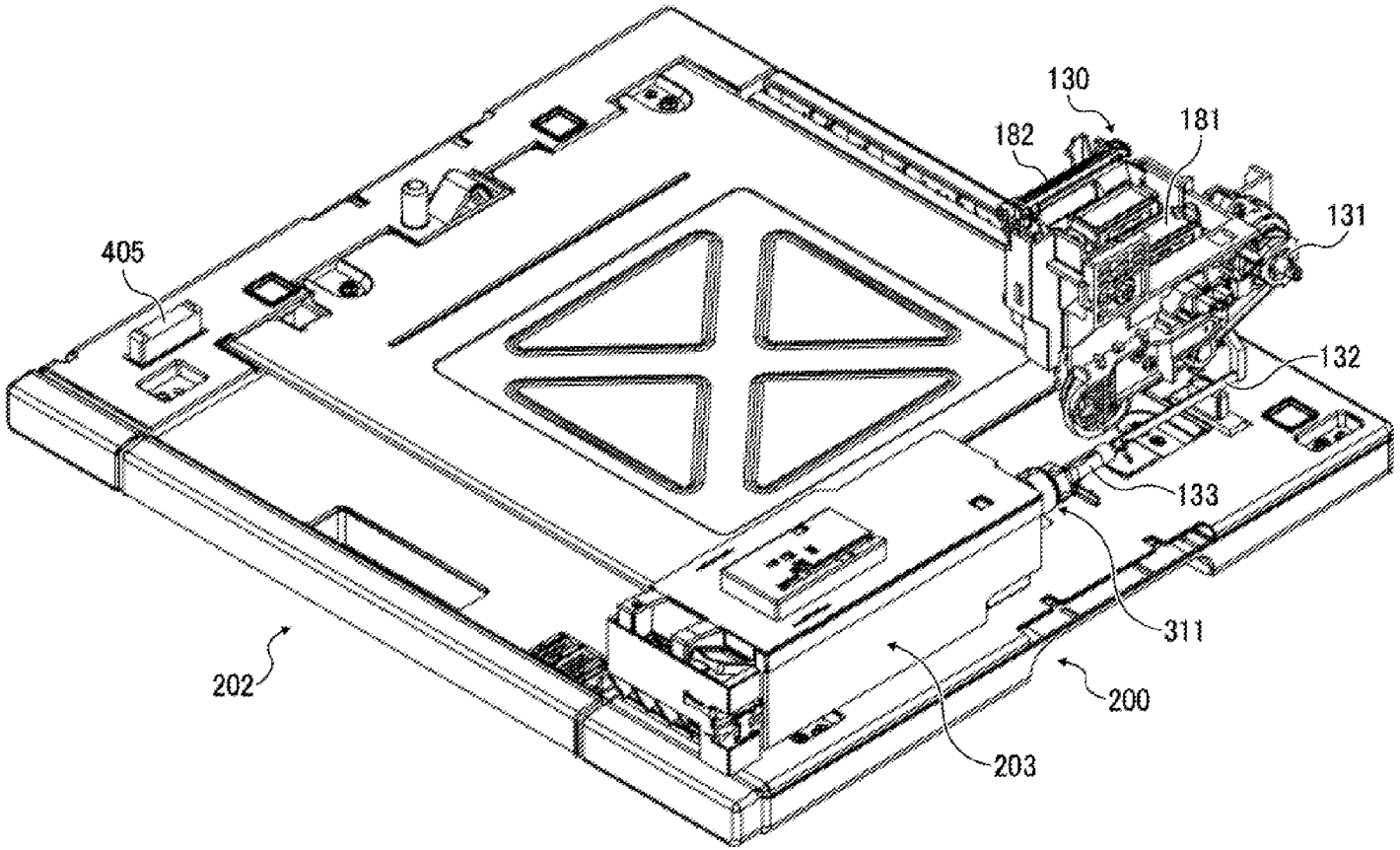
FIG. 36 is a perspective view of an entire configuration of a waste liquid drain system from a maintenance unit to a second waste liquid tank in the image forming apparatus.
Figure 37:
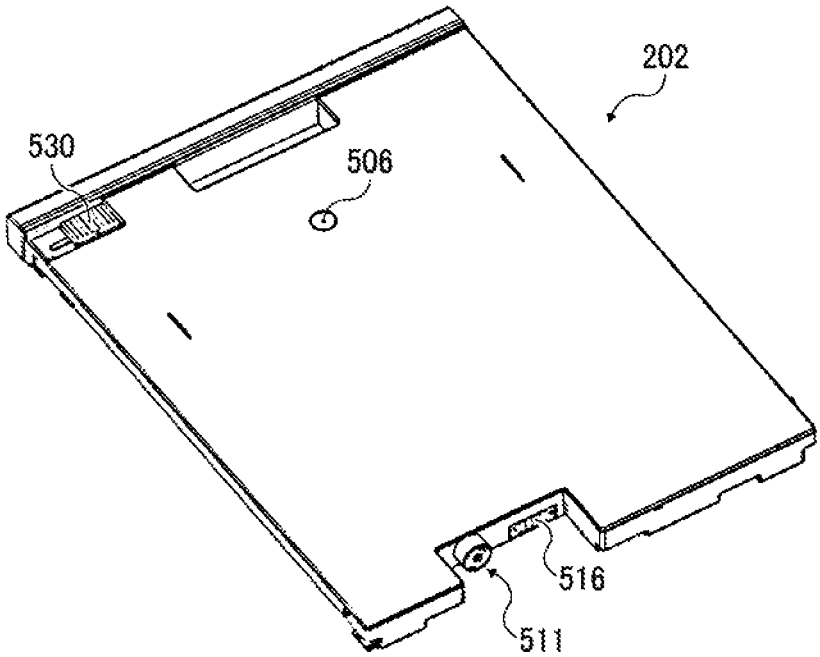
FIG. 37 is a perspective view of the second waste liquid tank in the fourth embodiment.
Figure 38:
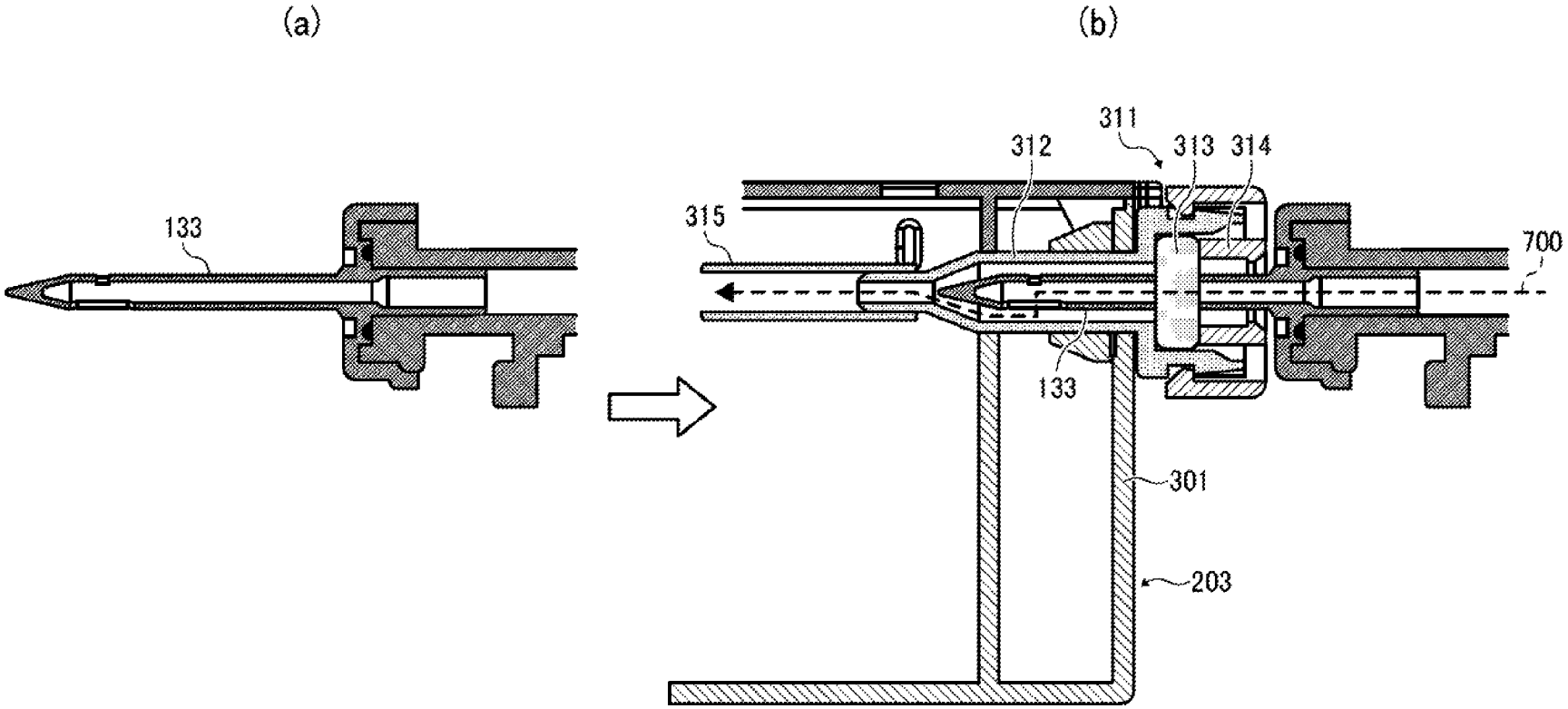
FIG. 38 is an illustration of a flow of waste liquid from a maintenance unit to a relay unit in the fourth embodiment.
Figure 39:
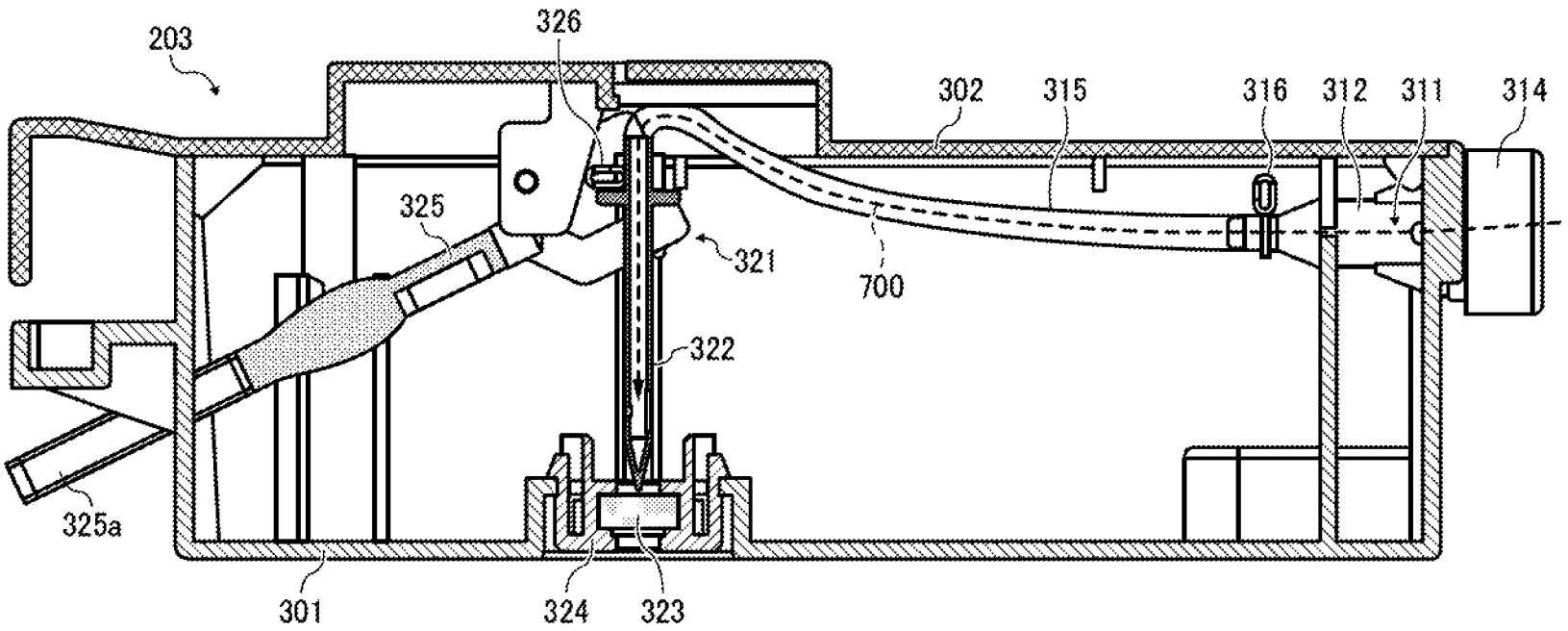
FIG. 39 is an illustration of a flow of waste liquid in the relay unit of FIG. 38.
Figure 40A:
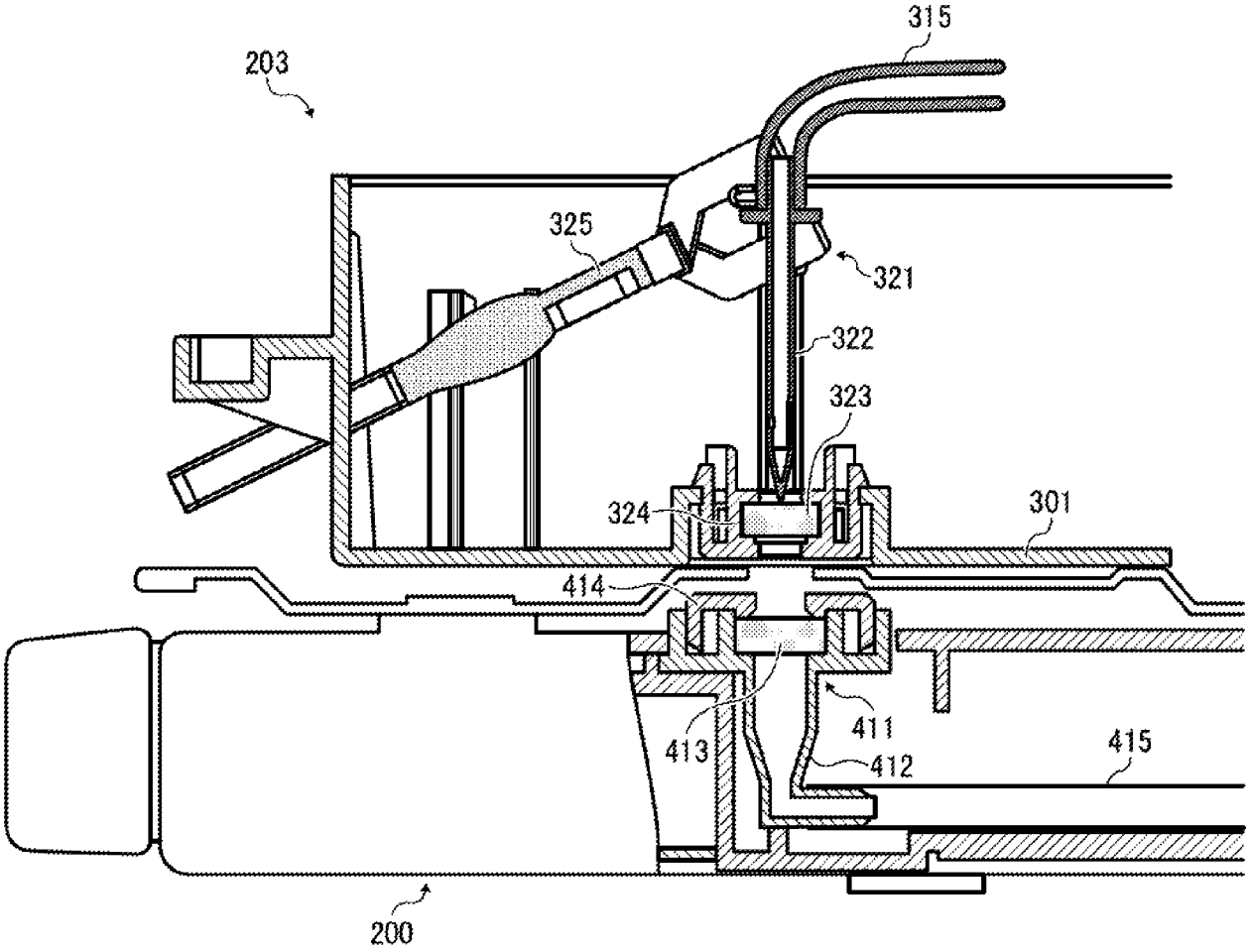
FIGS. 40A and 40B are illustrations of a flow of waste liquid from the relay unit to a second waste liquid tank accommodation unit.
Figure 40B:
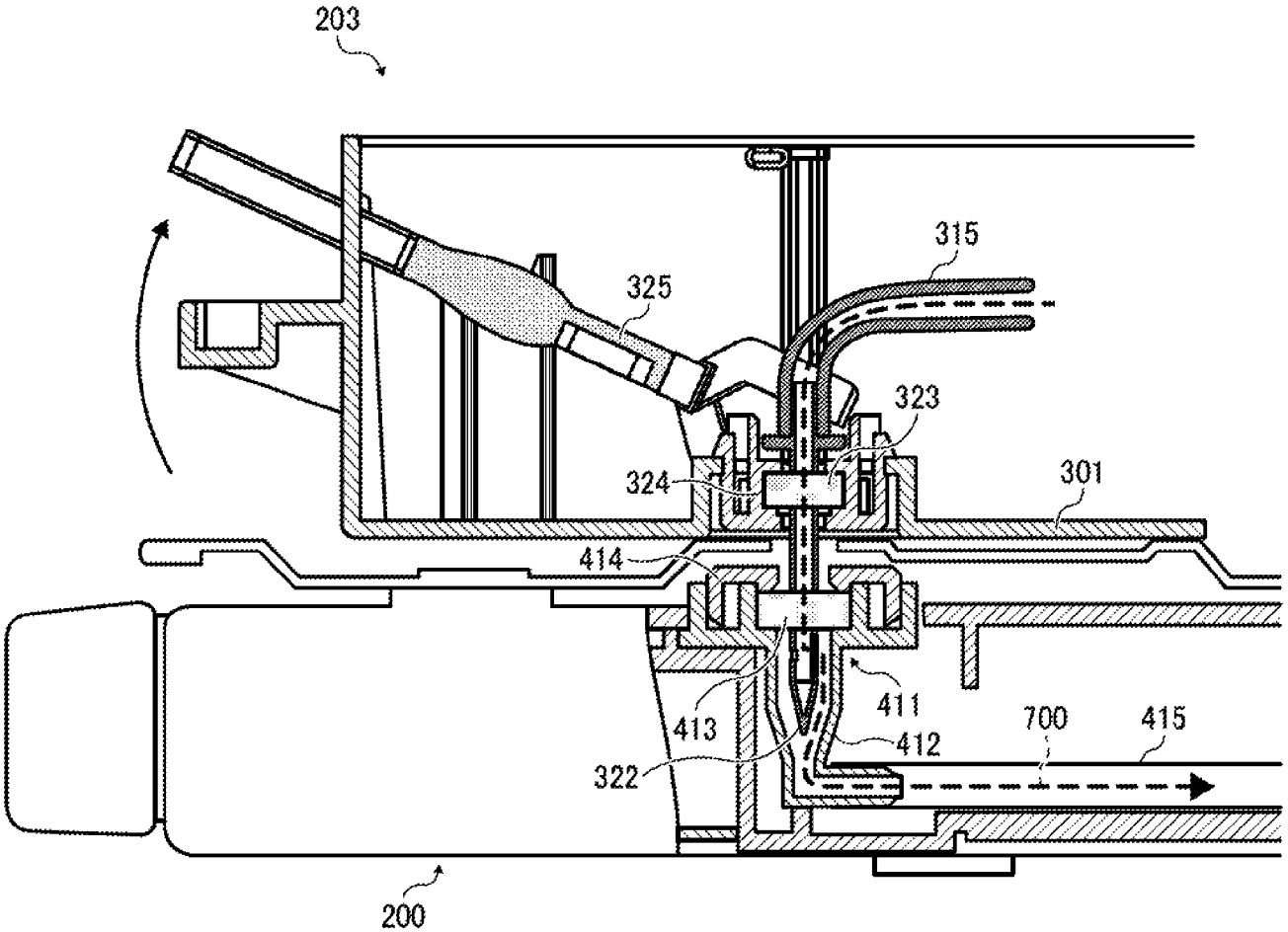
Figure 41:
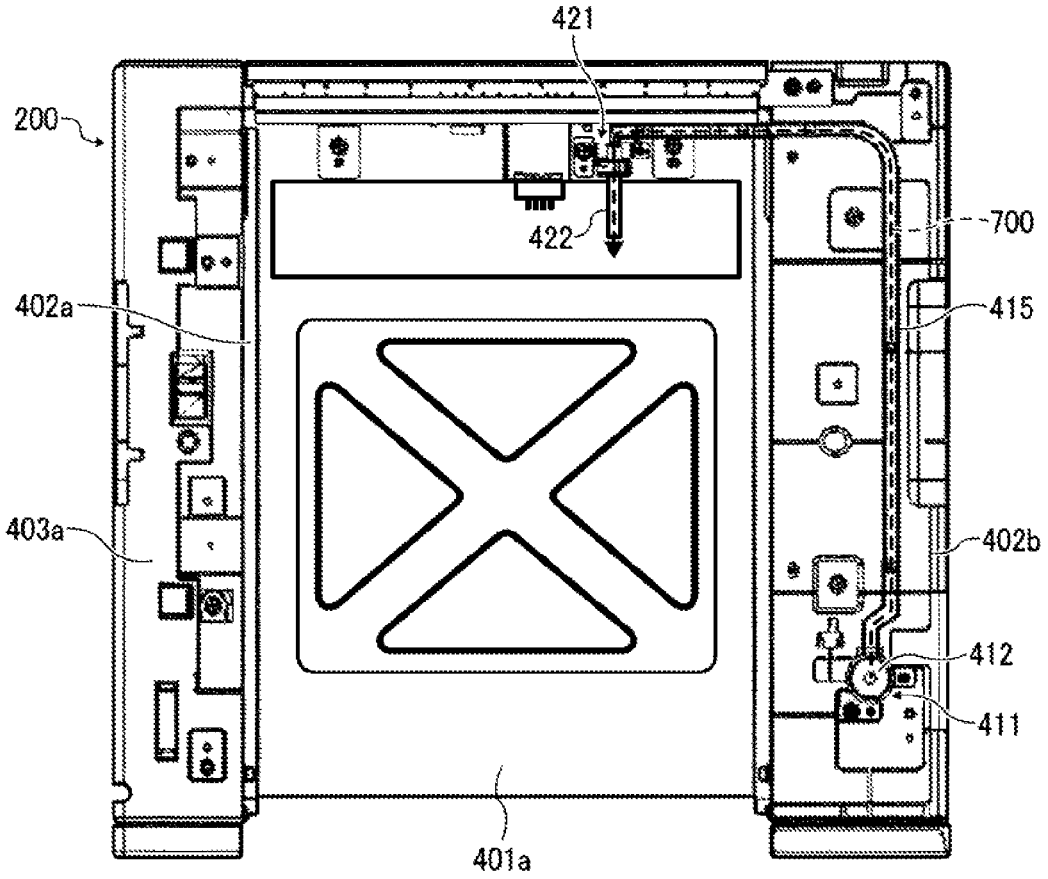
FIG. 41 is an illustration of a flow of waste liquid in the second waste liquid tank accommodation unit of FIGS. 40A and 40B.
Figure 42:
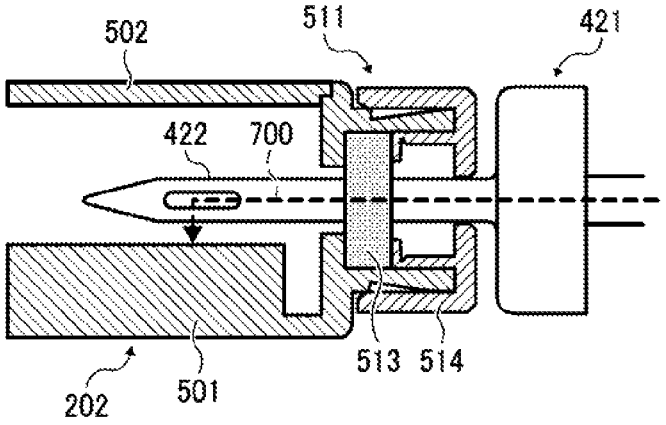
FIG. 42 is an illustration of a flow of waste liquid from the second waste liquid tank accommodation unit to the second waste liquid tank in the fourth embodiment.

Next, a flow of waste liquid from a maintenance unit to a second waste liquid tank in an image forming apparatus according to an embodiment of this disclosure is described with reference to FIGS. 36 through 42. FIG. 36 is a perspective view of an entire configuration of a waste liquid drain system in this embodiment. FIG. 37 is a perspective view of a second waste liquid tank in this embodiment. FIG. 38 is an illustration of a flow of waste liquid from a maintenance unit to a relay unit in this embodiment. FIG. 39 is an illustration of a flow of waste liquid in the relay unit of FIG. 38. FIGS. 40A and 40B are illustrations of a flow of waste liquid from the relay unit to a second waste liquid tank accommodation unit in this embodiment. FIG. 41 is an illustration of a flow of waste liquid in the second waste liquid tank accommodation unit of FIGS. 40A and 40B. FIG. 42 is an illustration of a flow of waste liquid from the second waste liquid tank accommodation unit to the second waste liquid tank in this embodiment.

As illustrated in FIG. 36, a maintenance unit 130 includes, for example, a cap 181 to cap a nozzle face of a recording head 152 (see FIG. 43), a wiper 182 to wipe the nozzle face, and a suction pump 131 connected to the cap 181.

The maintenance unit 130 maintains and recovers the performance of the recording head 152 by combining maintenance and recovery operations, such as, nozzle suction, dummy discharge, and wiping. In the nozzle suction, the maintenance unit 130 drive the suction pump 131 with the nozzle face capped with the cap 181. In the dummy discharge, the maintenance unit 130 discharges droplets (dummy discharge droplets) not contributing to image formation, into the cap 181. In the wiping, the maintenance unit 130 wipes the nozzle face with the wiper 182.

Waste liquid caused by such maintenance and recovery operations is drained to a needle 133 of a waste liquid drain passage member 134 by driving the suction pump 131.

In this embodiment, when a relay unit 203 and a second waste liquid tank 202 mounted to an apparatus body 101, waste liquid caused in the maintenance unit 130 is drained into the second waste liquid tank 202 (also illustrated in FIG. 37) from the maintenance unit 130 via the relay unit 203 and a second waste liquid tank accommodation unit 200.

In other words, the needle 133 serving as a drain passage member illustrated in FIG. 38A is connected to the inflow-side joint portion 311 of the relay unit 203. From this state, when waste liquid is fed from the maintenance unit 130, as indicated by arrow 700 in FIG. 38B, waste liquid is fed from the needle 133 into the tube 315.

Then, as indicated by arrow 700 in FIG. 39, waste liquid is fed from the tube 315 to the needle 322 via the outflow-side joint portion 321.

At this time, from the state illustrated in FIG. 10A, the relay unit 203 and the second waste liquid tank accommodation unit 200 are turned into a joined (connected) state illustrated in FIG. 39B. Thus, as indicated by arrow 700 in FIG. 40B, waste liquid is fed from the needle 322 of the relay unit 203 to the tube 415 via inflow-side joint portion 411 of the second waste liquid tank accommodation unit 200.

Then, as indicated by arrow 700 in FIG. 41, waste liquid is fed from inflow-side joint portion 411 to the needle 422 of the outflow-side joint portion 421 via the tube 415.

With the second waste liquid tank 202 mounted in the second waste liquid tank accommodation unit 200, as indicated by arrow 700 in FIG. 42, waste liquid is drained from the needle 422 of the outflow-side joint portion 421 into the second waste liquid tank 202.

Here, waste liquid is drained into the second waste liquid tank 202 with the relay unit 203 and the second waste liquid tank accommodation unit 200 being mounted in the apparatus body 101, the relay unit 203 and the second waste liquid tank accommodation unit 200 being connected to each other, and the second waste liquid tank 202 being mounted in the second waste liquid tank accommodation unit 200.

Figure 43:
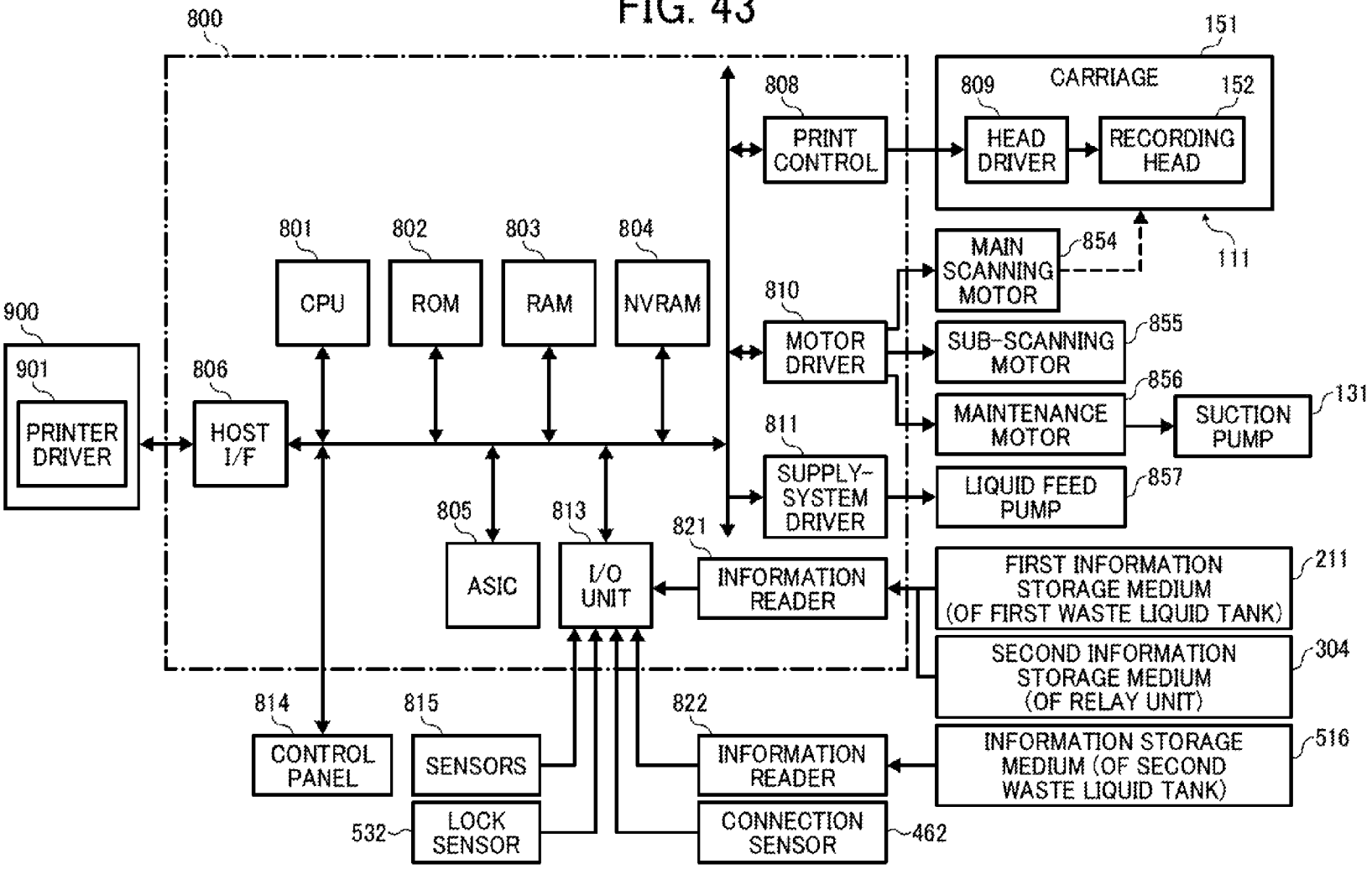
FIG. 43 is a block diagram of a controller of the image forming apparatus.

Next, an outline of a controller of the image forming apparatus is described with reference to FIG. 43. FIG. 43 is a block diagram of a controller of the image forming apparatus according to an embodiment of this disclosure.

A controller 800 according to this embodiment includes a central processing unit (CPU) 801, a read-only memory (ROM) 802, a random access memory (RAM) 803, a non-volatile random access memory (NVRAM) 804, and an application-specific integrated circuit (ASIC) 805. The CPU 801 manages the control of the entire image forming apparatus 100. The ROM 802 stores fixed data, such as various programs including programs relating to pump drive control according to embodiments of this disclosure and executed by the CPU 801, and the RAM 803 temporarily stores image data and other data.

The NVRAM 804 is a rewritable memory capable of retaining data even when the apparatus is powered off. The ASIC 805 processes various signals on image data, performs sorting or other image processing, and processes input and output signals to control the entire apparatus.

The controller 800 also includes a print control 808 and a head driver (driver integrated circuit) 809. The print control 808 includes a data transmitter and a driving signal generator to drive and control the recording heads 152. The head driver 809 drives the recording heads 152 mounted on the carriage 151.

The controller 800 further includes a main scanning motor 854, a sub-scanning motor 855, and a motor driver 810. The main scanning motor 854 moves the carriage unit 111 for scanning, and the sub-scanning motor 855 circulates the conveyance unit 112. The motor driver 810 drives a maintenance motor 856 of the maintenance unit 130 to move the cap 181 and the wiper 182 of the maintenance unit 130 or drive the suction pump 131.

The controller 800 further includes a supply system driver 811 to drive a liquid feed pump 857 to feed liquid from the main tanks 115 to the recording head 152 of the carriage unit 111.

The controller 800 is connected to a control panel 814 for inputting and displaying information necessary to the image forming apparatus 100.

The controller 800 includes a host interface (I/F) 806 for transmitting and receiving data and signals to and from a host side, and receives data and signals by the I/F 806 from a printer driver 901 of the host 900, such as an information processing device (e.g., personal computer), an image reading device, or an image pick-up device, via a cable or network.

The CPU 801 of the controller 800 reads and analyzes print data stored in a reception buffer of the I/F 806, performs desired image processing, data sorting, or other processing with the ASIC 805, and transfers image data from the print control 808 to the head driver 809.

The print control 808 transfers the above-described image data as serial data and outputs to the head driver 809, for example, transfer clock signals, latch signals, and control signals required for the transfer of image data and determination of the transfer.

In addition, the print control 808 includes the driving signal generator including, e.g., a digital/analog (D/A) converter (to perform digital/analog conversion on pattern data of driving pulses stored on the ROM 802), a voltage amplifier, and a current amplifier. The print control 808 outputs a driving signal containing one or more driving pulses from the driving signal generator to the head driver 809.

In accordance with serially-inputted image data corresponding to one line recorded by the recording heads 152, the head driver 809 selects driving pulses of a driving waveform transmitted from the print control 808 and applies the selected driving pulses to the pressure generator of the recording head 152. Thus, the recording head 152 is driven. At this time, by selecting a part or all of the driving pulses forming the driving waveform or a part or all of waveform elements forming a driving pulse, the recording heads 152 can selectively discharge dots of different sizes, e.g., large droplets, medium droplets, and small droplets.

The controller 800 includes an input/output (I/O) unit 813.

To the I/O unit 813, information is input that is read from an information reader 821 to read information from the first information storage medium 211 of the first waste liquid tank 201 and the second information storage medium 304 of the relay unit 203, which are replaced with each other and housed in the waste liquid tank accommodation part 120. Note that the term "information reader" used herein includes an information writer to write information onto an information storage medium.

When the second waste liquid tank 202 is mounted in the second waste liquid tank accommodation unit 200, information read from an information reader 822 to read information from an information storage medium 516 (see FIG. 37) of the second waste liquid tank 202 is input to the I/O unit 813.

A detection signal of the connection sensor 462 to detect that the relay unit 203 is connected to the second waste liquid tank accommodation unit 200 is input to the I/O unit 813. When the second waste liquid tank 202 is mounted in the second waste liquid tank accommodation unit 200, a lock detection signal from the lock sensor 532 is input to the I/O unit 813.

Besides, information from, e.g., a sensor to detect an ambient temperature, a cartridge sensor to detect opening of the cartridge cover, and various types of sensors 815 mounted in the image forming apparatus 100 are input to the I/O unit 813.

Figure 44:
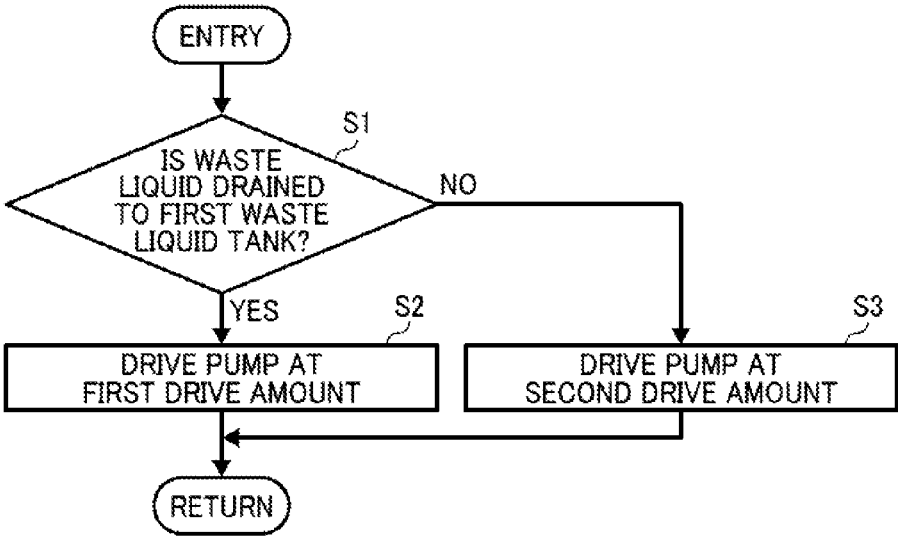
FIG. 44 is a flow chart of a process flow of pump drive control executed by the controller in a fifth embodiment of this disclosure.

Next, a fifth embodiment of the present disclosure is described with reference to FIG. 44. FIG. 44 is a flow chart of a process flow of pump drive control executed by the controller in the fifth embodiment.

In this embodiment, when waste liquid is drained, at S1 the controller 800 determines whether the drain destination is the first waste liquid tank 201 or not.

When the drain destination is the first waste liquid tank 201 (YES at S1), at S2 the suction pump 131 is driven at a first drive amount to feed waste liquid. Driving the suction pump 131 causes waste liquid to be fed into the waste liquid drain passage of the waste liquid drain passage member 134.

By contrast, when the drain destination is not the first waste liquid tank 201, in other words, when the drain destination is the second waste liquid tank 202 (NO at S1), at S3 the suction pump 131 is driven at a second drive amount, which is greater than the first drive amount, to feed waste liquid. That is, when waste liquid is drained to the second waste liquid tank 202, the suction pump 131 is driven at a greater drive amount than when waste liquid is drained to the first waste liquid tank 201.

Here, the drive amount of the suction pump 131 is determined by, for example, a drive time or a drive speed.

As described above, when the second waste liquid tank 202 is used, the relay unit 203 is mounted instead of the first waste liquid tank 201. Waste liquid is guided to the second waste liquid tank 202 via the relay unit 203 and the second waste liquid tank accommodation unit 200.

Accordingly, when waste liquid is drained to the second waste liquid tank 202, the distance at which waste liquid passes through the drain passage is longer than when waste liquid is drained to the first waste liquid tank 201. At this time, if the drive amount of the suction pump 131 is set to the same amount as when waste liquid is drained to the first waste liquid tank 201, waste liquid might stop and remains in the drain passage. Further, if waste liquid drain operation is not performed, for example, as printing is not performed for a long time, waste liquid might be thickened in the drain passage and clog a channel. When waste liquid drain operation is resumed, waste liquid might leak from, e.g., a joint portion of the drain passage, such as a joint portion of a tube.

Hence, in this embodiment, when waste liquid is drained to the second waste liquid tank 202, the suction pump 131 is driven at a greater drive amount than when waste liquid is drained to the first waste liquid tank 201. Such a configuration allows waste liquid to reliably arrive at the second waste liquid tank 202, thus preventing waste liquid from remaining and thickening in the drain passage to the second waste liquid tank 202.

Figure 45:
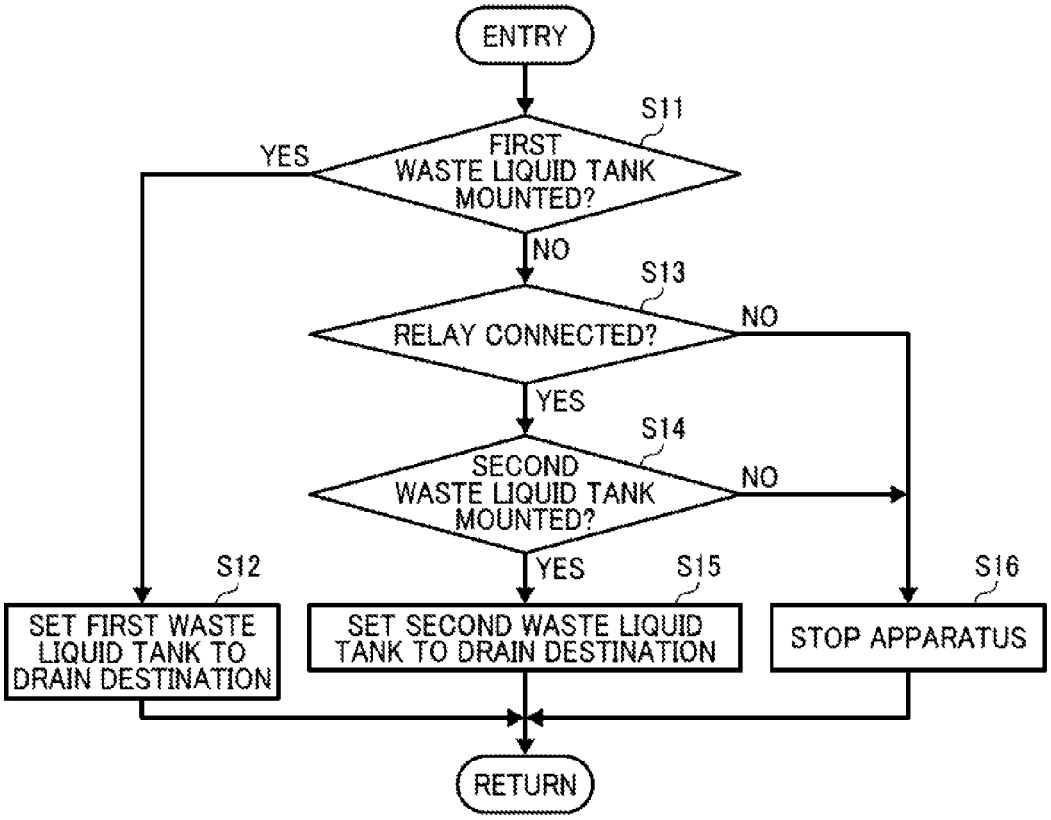
FIG. 45 is a flow chart of a process flow to determine a drain destination of waste liquid executed by the controller in a sixth embodiment of this disclosure.

Next, a sixth embodiment of the present disclosure will be described with reference to FIG. 45. FIG. 45 is a flow chart of a process flow to determine a drain destination of waste liquid executed by the controller in the sixth embodiment.

At S11, the controller 800 in this embodiment determines whether the first waste liquid tank 201 is mounted (set) in the waste liquid tank accommodation part 120. When the first waste liquid tank 201 is mounted in the waste liquid tank accommodation part 120 (YES at S11), at S12 the controller 800 sets the first waste liquid tank 201 to the drain destination of waste liquid. Note that the controller 800 determines whether the first waste liquid tank 201 is mounted in the first waste liquid tank 201, by reading information of the above-described information storage medium 211.

By contrast, when the first waste liquid tank 201 is not mounted in the waste liquid tank accommodation part 120 (NO at S11), at S13 the controller 800 determines whether the relay unit 203 and the second waste liquid tank accommodation unit 200 (collectively referred to as "relay") are connected to the waste liquid tank accommodation part 120. For example, the controller 800 determines whether the relay is connected to the waste liquid tank accommodation part 120, based on whether the controller 800 receives a detection signal of the connection sensor 462 indicating the connected state of the relay.

Here, when the relay unit 203 is mounted in and connected to the second waste liquid tank accommodation unit 200 (the relay is connected) (YES at S13), at S14 the controller 800 determines whether the second waste liquid tank 202 is mounted (set) in the second waste liquid tank accommodation unit 200.

When the relay unit 203 is mounted in and connected to the second waste liquid tank accommodation unit 200 (the relay is connected) (YES at S13) and the second waste liquid tank 202 is mounted in the second waste liquid tank accommodation unit 200 (YES at S14), at S15 the controller 800 sets the second waste liquid tank 202 to the drain destination of waste liquid.

By contrast, when the relay unit 203 is not mounted in or connected to the second waste liquid tank accommodation unit 200 (NO at S13) or when the second waste liquid tank 202 is not mounted in the second waste liquid tank accommodation unit 200 (NO at S14), at S16 the controller 800 stops the image forming apparatus 100.

Figure 46:
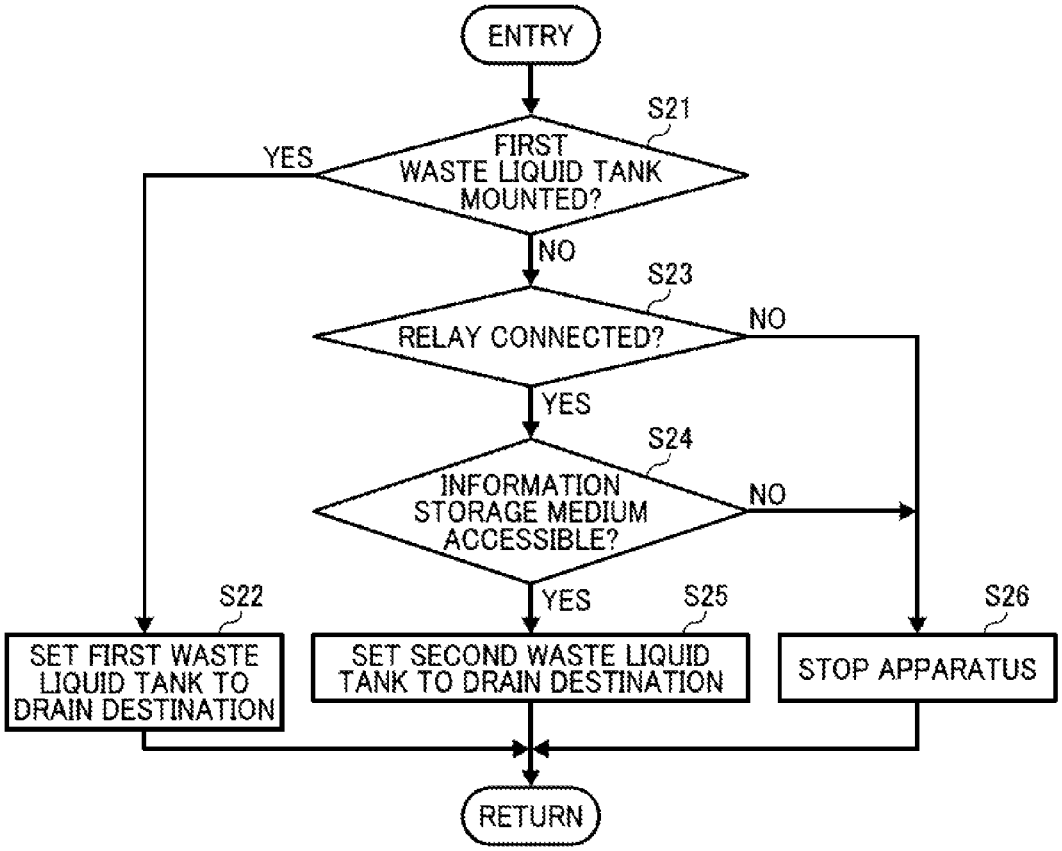
FIG. 46 is a flow chart of a process flow to determine a drain destination of waste liquid executed by the controller in a seventh embodiment of this disclosure.

Next, a seventh embodiment of the present disclosure will be described with reference to FIG. 46. FIG. 46 is a flow chart of a process flow to determine a drain destination of waste liquid executed by the controller in the seventh embodiment.

At S21, like the above-described sixth embodiment, the controller 800 determines whether the first waste liquid tank 201 is mounted in the waste liquid tank accommodation part 120. When the first waste liquid tank 201 is mounted in the waste liquid tank accommodation part 120 (YES at S21), at S22 the controller 800 sets the first waste liquid tank 201 to the drain destination of waste liquid.

By contrast, when the first waste liquid tank 201 is not mounted in the waste liquid tank accommodation part 120 (NO at S21), at S23 the controller 800 determines whether the relay unit 203 is mounted in and connected to the second waste liquid tank accommodation unit 200 (the relay is connected) or not. The controller 800 determines whether the relay is connected to the second waste liquid tank accommodation unit 200, based on whether the controller 800 receives a detection signal of the connection sensor 462 indicating the connected state of the relay.

When the relay unit 203 is mounted in and connected to the second waste liquid tank accommodation unit 200 (YES at S23), at S24 the controller 800 determines whether the information reader 822 reads information of the information storage medium 516 of the second waste liquid tank 202 (the information storage medium 516 is accessible). When the information storage medium 516 is accessible (YES at S24), the controller 800 determines that the second waste liquid tank 202 is mounted in the second waste liquid tank accommodation unit 200.

Accordingly, when the relay unit 203 is mounted in and connected to the second waste liquid tank accommodation unit 200 (YES at S23) and the second waste liquid tank 202 is mounted in the second waste liquid tank accommodation unit 200 (YES at S24), at S25 the controller 800 sets the second waste liquid tank 202 to the drain destination of waste liquid.

By contrast, when the relay unit 203 is not mounted in or connected to the second waste liquid tank accommodation unit 200 (NO at S13) or when the second waste liquid tank 202 is not mounted in the second waste liquid tank accommodation unit 200 (NO at S14), at S16 the controller 800 stops the image forming apparatus 100.

Note that the information storage medium 516, e.g., an identification (ID) chip, of the second waste liquid tank 202 stores information for, e.g., management of the amount of waste liquid and maintenance history. The second waste liquid tank accommodation unit 200 includes a connector to contact the information storage medium 516, and reads and writes information from and into the information storage medium 516 via the connector.

Accordingly, the controller 800 can determine whether the second waste liquid tank 202 is mounted, based on whether the information storage medium 516 is accessible.

Figure 47:
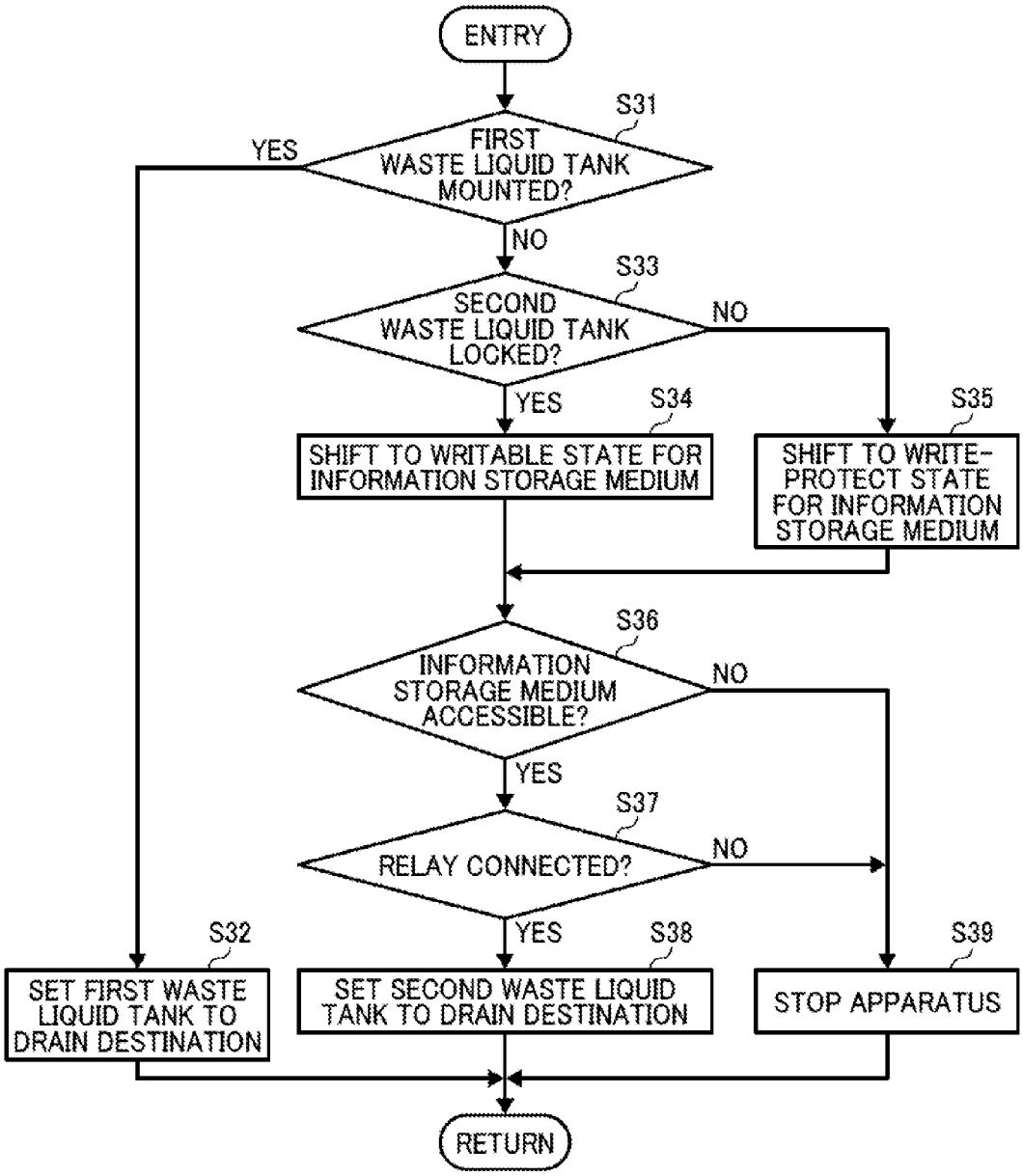
FIG. 47 is a flow chart of a process flow to determine a drain destination of waste liquid executed by the controller in an eighth embodiment of this disclosure.

Next, an eighth embodiment of the present disclosure will be described with reference to FIG. 47. FIG. 47 is a flow chart of a process flow to determine a drain destination of waste liquid executed by the controller in the eighth embodiment.

At S31, like the above-described sixth embodiment, the controller 800 determines whether the first waste liquid tank 201 is mounted in the waste liquid tank accommodation part 120. When the first waste liquid tank 201 is mounted in the waste liquid tank accommodation part 120 (YES at S31), at S32 the controller 800 sets the first waste liquid tank 201 to the drain destination of waste liquid.

By contrast, when the first waste liquid tank 201 is not mounted in the waste liquid tank accommodation part 120 (NO at S31), at S33 the controller 800 determines whether the lock sensor 532 of the second waste liquid tank accommodation unit 200 detects the locked state of the second waste liquid tank 202.

When the lock sensor 532 detects the locked state (YES at S33), at S34 the controller 800 shifts to a writable state for the information storage medium 516. By contrast, when the lock sensor 532 does not detect the locked state, in other words, detects the unlocked state of the second waste liquid tank 202 (YES at S33), at S35 the controller 800 shifts to a write-protect state for the information storage medium 516.

At S36 the controller 800 determines whether the information reader 822 reads information of the information storage medium 516 of the second waste liquid tank 202 (the information storage medium 516 is accessible). When the information storage medium 516 is accessible (YES at S36), the controller 800 determines that the second waste liquid tank 202 is mounted in the second waste liquid tank accommodation unit 200.

Thus, when the information storage medium 516 is accessible (YES at S36), at S37 the controller 800 determines whether the relay unit 203 is mounted in and connected to the second waste liquid tank accommodation unit 200. As described above, the controller 800 determines whether the relay is connected to the second waste liquid tank accommodation unit 200, based on whether the controller 800 receives a detection signal of the connection sensor 462 indicating the connected state of the relay.

When the relay unit 203 is mounted in and connected to the second waste liquid tank accommodation unit 200 (YES at S37), at 385 the controller 800 sets the second waste liquid tank 202 to the drain destination of waste liquid.

By contrast, when the information storage medium 516 is not accessible (NO at S36) or when the relay unit 203 is not mounted in or connected to the second waste liquid tank accommodation unit 200 (NO at S37), at S39 the controller 800 stops the image forming apparatus 100.

In this embodiment, garbled data of the information storage medium 516, which might occur in the information storage medium 516 of the above-described seventh embodiment, is prevented as follow.

For example, in a configuration in which the second waste liquid tank 202 is detected based on whether the information storage medium 516 is accessible or not, the second waste liquid tank 202 might be removed during operation of the image forming apparatus 100. If the second waste liquid tank 202 is removed during access to the information storage medium 516, a contact point of the information storage medium 516 might lose stability and cause garbled data.

Hence, when the lock sensor 532 to detect the locked state of the second waste liquid tank 202 is used and the second waste liquid tank 202 is locked with the lock lever 530, access to the information storage medium 516 is permitted.

When the second waste liquid tank 202 is not locked with the lock lever 530, access to the information storage medium 516 is prohibited.

Such a configuration prevents the second waste liquid tank 202 from being removed during access to the information storage medium 516, thus preventing garbled data.

Figure 48:
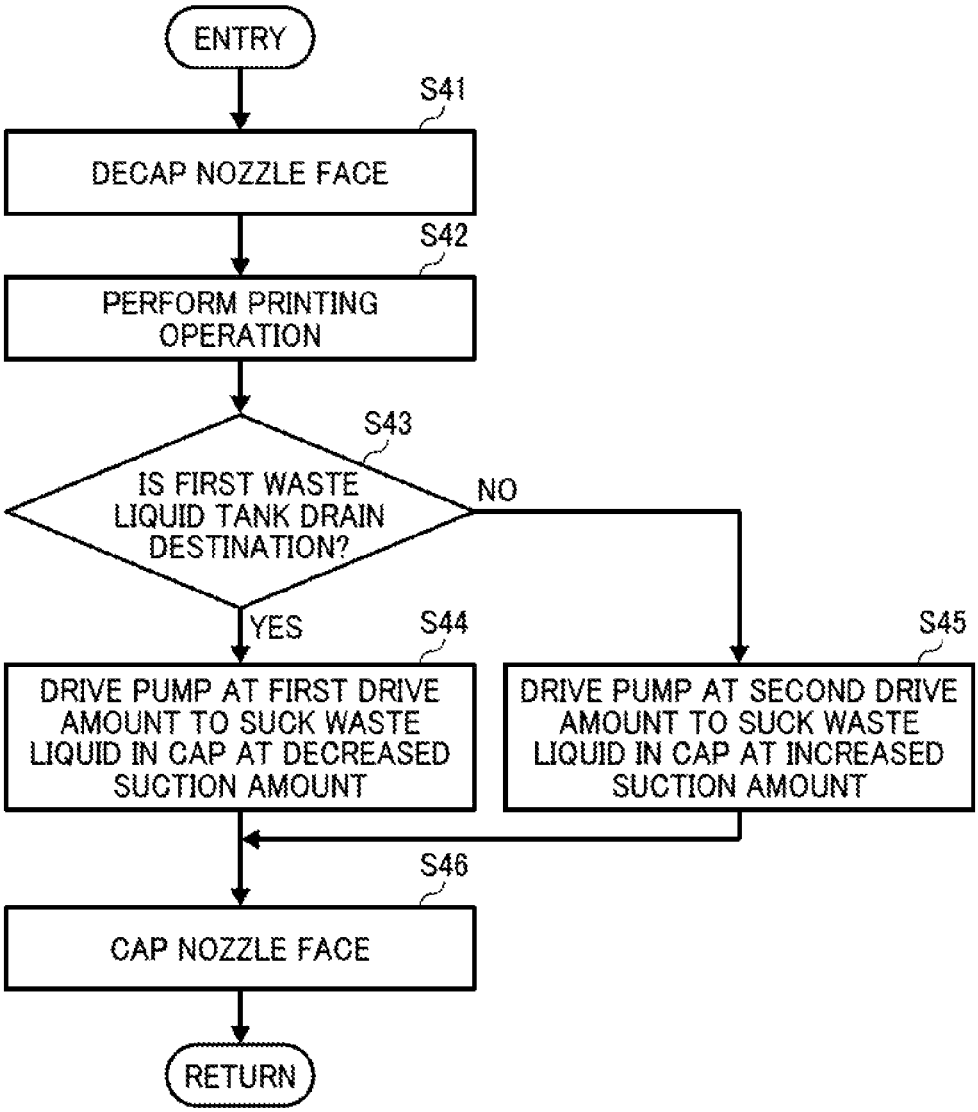
FIG. 48 is a flow chart of a process flow of maintenance and recovery control executed by the controller in a ninth embodiment of this disclosure.

Next, a ninth embodiment of the present disclosure is described with reference to FIG. 48. FIG. 48 is a flow chart of a process flow of maintenance and recovery control executed by the controller in the ninth embodiment.

When performing printing operation, at S41 the controller 800 detaches (decaps) the nozzle face of the recording head 152 from the cap 181 and at S42 shifts to the printing operation. Before shifting to the printing operation, the controller 800 causes the recording head 152 to perform dummy discharge of droplets into the cap 181 and then performs the printing operation. The dummy discharge into the cap 181 may be performed during and after printing, as well as before printing.

After the printing operation is performed at S42, at S43 the controller 800 determines whether the drain destination of waste liquid is the first waste liquid tank 201 or not when waste liquid in the cap 181 is drained before capping.

When the drain destination is the first waste liquid tank 201 (YES at S43), at S44 the controller 800 causes the suction pump 131 to be driven at a first drive amount. In other words, the controller 800 sets a decreased suction amount at which waste liquid in the cap 181 is sucked by the suction pump 131.

By contrast, when the drain destination is not the first waste liquid tank 201, in other words, when the drain destination is the second waste liquid tank 202 (NO at S43), at S45 the controller 800 causes the suction pump 131 to be driven at a second drive amount, which is greater than the first drive amount. In other words, the controller 800 sets an increased suction amount at which waste liquid in the cap 181 is sucked by the suction pump 131.

Accordingly, at the end of the printing operation, waste liquid can be reliably drained from the drain passage.

At S46, the controller 800 causes the nozzle face of the recording head 152 to be capped with the cap 181.

Figure 49:
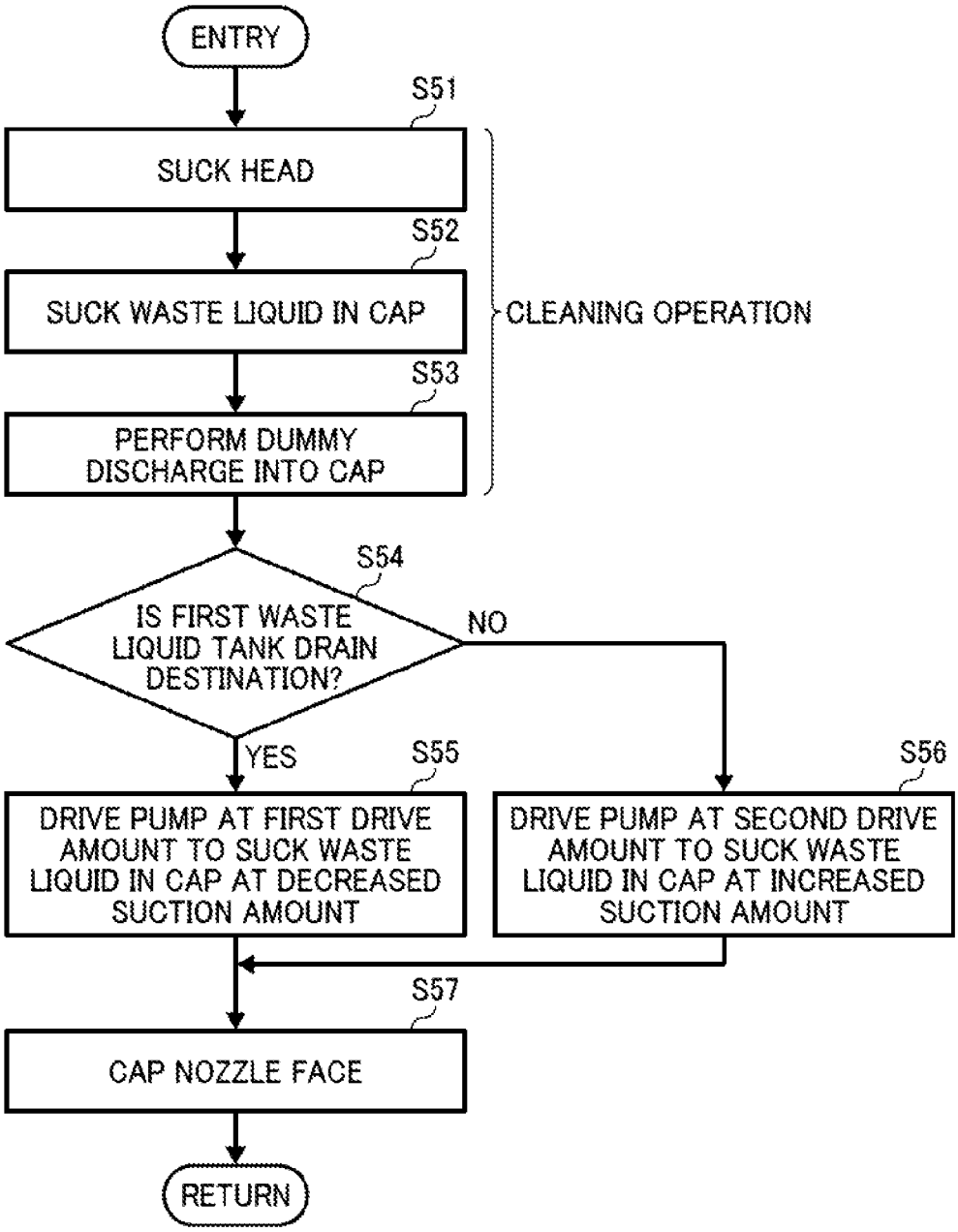
FIG. 49 is a flow chart of a process flow of maintenance and recovery control executed by the controller in a tenth embodiment of this disclosure.

Next, a tenth embodiment of the present disclosure is described with reference to FIG. 49. FIG. 49 is a flow chart of a process flow of maintenance and recovery control executed by the controller in the ninth embodiment.

In this embodiment, cleaning operation is conducted as one type of maintenance operation. In the cleaning operation, when head suction (suction and drain of liquid from nozzles) is performed at S51, at S52 the controller 800 causes the suction pump 131 to suck and drain waste liquid from the inside of the cap 181 and at S53 causes the recording head 152 to dummy-discharge liquid into the cap 181. As described above, in the maintenance operation including head suction, dummy discharge is performed to prevent mixture of different colors and obtain the stability of meniscus.

As described above, for the maintenance operation in which each of the head suction and the dummy discharge into the cap 181 is once performed, waste liquid is accumulated twice in the cap 181. In other words, for the maintenance operation in this embodiment, an operation including drain of waste liquid into the cap 181 is performed plural times.

In this case, suction of liquid from the inside of the cap 181 is performed after the head suction. Such intra-cap suction is performed to remove waste liquid in the cap 181, and it is not necessarily necessary to feed waste liquid to the waste liquid tank.

Hence, for the intra-cap suction in the cleaning operation, even when waste liquid is drained into the second waste liquid tank 202, in other words, even when the distance at which waste liquid passes through the drain passage is longer, the suction amount (drive amount) of the suction pump 131 is not changed.

Such a configuration can reduce the maintenance time and enhance the durability of the suction pump.

After the dummy discharge into the cap 181 in the cleaning operation ends, in other words, after waste liquid is finally drained into the cap 181 when the maintenance operation in which an operation including drain of waste liquid into the cap 181 is performed plural times, like the above-described ninth embodiment, at S54 the controller 800 determines whether the drain destination of waste liquid is the first waste liquid tank 201 or not.

When the drain destination is the first waste liquid tank 201 (YES at S54), at S55 the controller 800 causes the suction pump 131 to be driven at a first drive amount. In other words, the controller 800 sets a decreased suction amount at which waste liquid in the cap 181 is sucked by the suction pump 131.

By contrast, when the drain destination is not the first waste liquid tank 201, in other words, when the drain destination is the second waste liquid tank 202 (NO at S54), at S56 the controller 800 causes the suction pump 131 to be driven at a second drive amount, which is greater than the first drive amount. In other words, the controller 800 sets an increased suction amount at which waste liquid in the cap 181 is sucked by the suction pump 131. At S57, the controller 800 causes the nozzle face of the recording head 152 to be capped with the cap 181.

Figure 50:
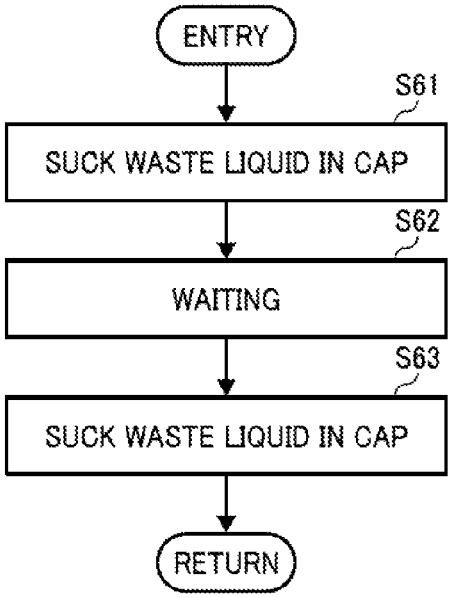
FIG. 50 is a flow chart of a process flow of pump drive control executed by the controller in an eleventh embodiment of this disclosure.
Figure 51A:
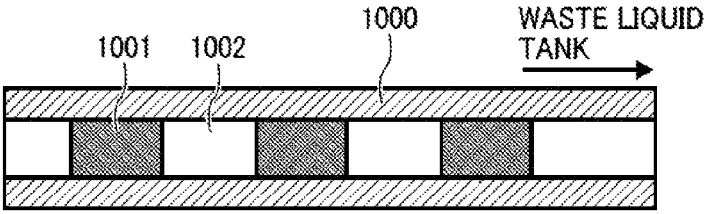
FIGS. 51A, 51B, and 51C are illustrations of the pump drive control.
Figure 51B:
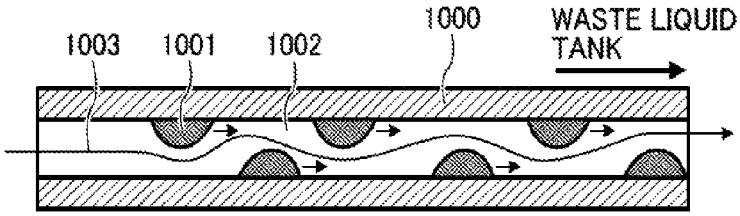
Figure 51C:
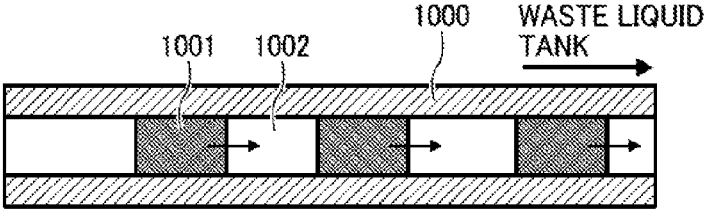

Next, an eleventh embodiment of the present disclosure is described with reference to FIGS. 50, 51A, 51B, and 51C. FIG. 50 is a flow chart of a process flow of pump drive control executed by the controller in the eleventh embodiment. FIGS. 51A through 51C are illustrations of the pump drive control.

In this embodiment, when waste liquid in the cap 181 is drained, at S61 the suction pump 131 is driven to suck waste liquid into the cap 181 (intra-cap suction). At S62, the suction pump 131 is stopped (waiting time). At S63, the suction pump 131 is driven to suck waste liquid into the cap 181 (intra-cap suction). Thus, the suction pump 131 is intermittently driven. Note that the intra-cap suction may be performed three or more times.

In other words, since the drain passage of waste liquid is in a mixed state of air and liquid, formation of a channel of air may hamper feeding waste liquid even after waste liquid drain operation is performed for a long time. However, once the waste liquid drain operation is stopped, the channel of air is blocked with waste liquid. Then, resuming the waste liquid drain operation allows waste liquid to be effectively drained.

For example, as illustrated in FIG. 51A, with the suction pump 131 stopped, waste liquid 1001 and an air layer 1002 separate from each other in a waste liquid drain passage 1000, and the waste liquid drain passage 1000 is blocked with the waste liquid 1001.

In this state, when the suction pump 131 is driven, the waste liquid 1001 is fed. However, over time, as illustrated in FIG. 51B, the waste liquid 1001 moves toward a wall of the waste liquid drain passage 1000, thus forming an air channel 1003. In this stage, even if the suction pump 131 is driven, the waste liquid 1001 cannot be fed.

Hence, when driving of the suction pump 131 is stopped, as illustrated in FIG. 51C, the waste liquid 1001 blocks the waste liquid drain passage 1000 again, thus turning the waste liquid drain passage 1000 into a state in which the waste liquid 1001 can be fed. Hence, re-driving of the suction pump 131 causes the waste liquid 1001 to gradually move toward the waste liquid tank.

As described above, performing the intermittent driving of the suction pump 131 allows the waste liquid 1001 to be effectively moved toward and drained into the waste liquid tank.

Note that the term "image forming apparatus" refers to an apparatus that discharges liquid on a medium to form an image on the medium. The medium is made of, for example, paper, string, fiber, cloth, leather, metal, plastic, glass, wood, and ceramic. The term "image formation", which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "image" used herein is not limited to a two-dimensional image and includes, for example, an image applied to a three dimensional object and a three dimensional object itself formed as a three-dimensionally molded image.

The term "image forming apparatus" includes both serial-type image forming apparatus and line-type image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an apparatus body;

a waste liquid container accommodation part to replaceably accommodate a first waste liquid container to contain waste liquid; and a waste liquid drain passage member to guide waste liquid into the waste liquid container accommodation part, the apparatus body including a mount portion to mount a second waste liquid container having a capacity greater than the waste liquid container accommodation part, the mount portion of the apparatus body being different from the waste liquid container accommodation part, the waste liquid container accommodation part to accommodate a relay unit to relay a drain passage from the waste liquid drain passage member to the second waste liquid container, replaceably with the first waste liquid container.

2. The image forming apparatus according to claim 1, further comprising:

a connector to switch a connected state and an unconnected state of the drain passage from the waste liquid drain passage member to the second waste liquid container; and a lever movable to switch the connected state and the unconnected state of the drain passage with the connector.

3. The image firming apparatus according to claim 2, wherein the lever is movable only in a state in which the relay unit is accommodated in the waste liquid container accommodation part.

4. The image forming apparatus according to claim 2, further comprising a connection sensor to detect that the connector is in the connected state.

5. The image forming apparatus according to claim 1, wherein the first waste liquid container includes an information storage medium to store information, wherein the relay unit includes an information storage medium to store information, and wherein the information stored in the information storage medium of the first waste liquid container is different from the information stored in the information storage medium of the relay unit.

6. The image forming apparatus according to claim 1, wherein the relay unit includes an information storage medium to store information identifying the relay unit.

7. The image forming apparatus according to claim 1, further comprising:

a pump to feed waste liquid to a waste liquid drain passage in the waste liquid drain passage member; and a pump drive controller to control driving of the pump, wherein, when waste liquid is drained into the second waste liquid container, the pump drive controller controls the pump to be driven at a second drive amount greater than a first drive amount at which the pump is driven when waste liquid is drained into the first waste liquid container.

8. The image forming apparatus according to claim 7, further comprising:

a liquid discharge head to discharge liquid; and a cap to cap a nozzle face of the liquid discharge head, wherein, when waste liquid is fed into the waste liquid drain passage, the pump drive controller controls the pump to be driven at the second drive amount.

9. The image forming apparatus according to claim 7, further comprising:

a liquid discharge head to discharge liquid; and a cap to cap a nozzle face of the liquid discharge head, wherein, in a maintenance operation in which an operation including drain of waste liquid into the cap is performed plural times, when waste liquid is fed into the waste liquid drain passage after waste liquid is finally discharged into the cap, the pump drive controller controls the pump to be driven at the second drive amount.

10. The image forming apparatus according to claim 7, wherein, when the drain passage from the waste liquid drain passage member to the second waste liquid container is in a connected state and the second waste liquid container is mounted, the pump drive controller controls the pump to be driven at the second drive amount.

11. The image forming apparatus according to claim 7, wherein the pump drive controller controls the pump to be intermittently driven at the second drive amount.

12. A relay unit for a waste liquid container of an image forming apparatus, the relay unit comprising a first connector and a second connector to be connected to a waste liquid drain passage member and a second waste liquid container, respectively, of the image forming apparatus to relay a drain passage from the waste liquid drain passage member to the second waste liquid container, the waste liquid drain passage member to guide waste liquid to a waste liquid container accommodation part of the image forming apparatus, the second waste liquid container having a capacity greater than a first waste liquid container and mountable to a portion of the image forming apparatus different from the waste liquid container accommodation part, the waste liquid container accommodation part of the image forming apparatus to replaceably accommodate the first waste liquid container, wherein the second connector is configured and disposed to switch a connected state and an unconnected state of the drain passage from the waste liquid drain passage member to the second waste liquid container; and a lever movable to switch the connected state and the unconnected state of the drain passage with the second connector, wherein the relay unit is mountable in the waste liquid container accommodation part of the image forming apparatus, replaceably with the first waste liquid container.

* * * * *